US008369717B2

(12) United States Patent
Rimai et al.

(10) Patent No.: US 8,369,717 B2
(45) Date of Patent: Feb. 5, 2013

(54) DETERMINING DEVELOPER TONER CONCENTRATION IN ELECTROPHOTOGRAPHIC PRINTER

(75) Inventors: Donald S. Rimai, Webster, NY (US); Kenneth J. Brown, Penfield, NY (US); Charles H. Hasenauer, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 341 days.

(21) Appl. No.: 12/869,798

(22) Filed: Aug. 27, 2010

(65) Prior Publication Data

US 2012/0051759 A1 Mar. 1, 2012

(51) Int. Cl.
*G03G 15/08* (2006.01)

(52) U.S. Cl. ..... 399/27; 399/30

(58) Field of Classification Search ..... 399/27, 399/30, 58, 62

See application file for complete search history.

(56) References Cited

U.S. PATENT DOCUMENTS

| | | | | |
|---|---|---|---|---|
| 4,519,696 | A | | 5/1985 | Bruyndonckx |
| 4,987,453 | A | | 1/1991 | Laukaitis |
| 5,006,897 | A | | 4/1991 | Rimai et al. |
| 5,122,842 | A | | 6/1992 | Rimai |
| 5,235,388 | A | | 8/1993 | Rimai et al. |
| 5,285,243 | A | | 2/1994 | Rimai et al. |
| 5,463,449 | A | | 10/1995 | Morse et al. |
| 5,532,802 | A | * | 7/1996 | Sonnenberg et al. ..... 399/58 |
| 5,655,183 | A | | 8/1997 | Tombs |
| 6,148,160 | A | * | 11/2000 | Maess et al. ..... 399/53 |
| 6,294,304 | B1 | | 9/2001 | Sukovich |
| 6,498,908 | B2 | | 12/2002 | Phillips |
| 6,608,641 | B1 | | 8/2003 | Alexandrovich et al. |
| 7,120,379 | B2 | | 10/2006 | Eck et al. |
| 2002/0168200 | A1 | | 11/2002 | Stelter |
| 2006/0133870 | A1 | | 6/2006 | Ng et al. |
| 2010/0150592 | A1 | | 6/2010 | Brown |

OTHER PUBLICATIONS

A Piezolectric sensor for in situ monitoring of xerographic developers, by Rimai et al; Journal of Imaging Science and Technology, vol. 39, 1995, pp. 136-141.

The Journal of Applied Physics 58(7) A sensitive New Method for the Determination of Adhesive Bonding between a Particle and a Substrate, G. L. Dybwad, Oct. 1, 1985, pp. 2789-2790.

* cited by examiner

*Primary Examiner* — Hoang Ngo
(74) *Attorney, Agent, or Firm* — Christopher J. White

(57) ABSTRACT

A piezoelectric crystal adjacent to a development member in an electrophotographic printer has an electrode on it facing the development member. An AC bias is applied across the crystal while a DC bias is applied between the electrode and the development member to measure toner-mass deposition rate. An AC bias is then applied between the electrode and the development member to measure developer flow rate. The toner concentration of the developer is determined using the measured toner mass-deposition rate and developer flow rate.

14 Claims, 16 Drawing Sheets

| Plate Area in^2 | Amplitude P-P kV | Frequency kHz | Spacing in | Slope | Intercept | R^2 |
|---|---|---|---|---|---|---|
| 0.5 | 1 | 1 | 0.05 | 0.009 | 0.573 | 0.723 |
| 0.5 | 1 | 1 | 0.09 | 0.005 | 0.587 | 0.982 |
| 0.5 | 1 | 3 | 0.05 | 0.009 | 1.731 | 0.701 |
| 0.5 | 1 | 3 | 0.09 | 0.006 | 1.706 | 0.523 |
| 0.5 | 2 | 2 | 0.07 | 0.011 | 2.229 | 0.692 |
| 0.5 | 3 | 1 | 0.05 | 0.007 | 1.791 | 0.642 |
| 0.5 | 3 | 1 | 0.09 | -0.004 | 1.704 | 0.913 |
| 0.5 | 3 | 3 | 0.09 | 0.057 | 5.055 | 0.999 |
| 0.5 | 3 | 3 | 0.05 | 0.047 | 5.160 | 1.000 |
| 1 | 1 | 2 | 0.07 | 0.007 | 1.140 | 0.913 |
| 1 | 2 | 1 | 0.07 | 0.014 | 1.195 | 0.999 |
| 1 | 2 | 2 | 0.07 | 0.061 | 2.158 | 0.994 |
| 1 | 2 | 2 | 0.05 | 0.040 | 2.246 | 0.976 |
| 1 | 2 | 2 | 0.07 | 0.035 | 2.303 | 0.996 |
| 1 | 2 | 2 | 0.09 | 0.023 | 2.224 | 0.576 |
| 1 | 2 | 2 | 0.07 | 0.023 | 2.293 | 0.702 |
| 1 | 2 | 3 | 0.07 | 0.036 | 3.507 | 0.942 |
| 1 | 3 | 2 | 0.07 | 0.065 | 3.296 | 0.861 |
| 2 | 1 | 1 | 0.05 | 0.024 | 0.612 | 0.988 |
| 2 | 1 | 1 | 0.09 | 0.009 | 0.656 | 0.991 |
| 2 | 1 | 3 | 0.05 | 0.061 | 2.026 | 0.991 |
| 2 | 1 | 3 | 0.09 | 0.029 | 1.850 | 0.967 |
| 2 | 2 | 2 | 0.07 | 0.044 | 2.507 | 0.993 |
| 2 | 3 | 1 | 0.05 | 0.078 | 2.036 | 0.999 |
| 2 | 3 | 1 | 0.09 | 0.038 | 1.860 | 0.787 |
| 2 | 3 | 3 | 0.05 | 0.184 | 6.132 | 0.992 |
| 2 | 3 | 3 | 0.09 | 0.091 | 5.650 | 0.989 |

*FIG. 6C*

DETERMINING DEVELOPER TONER CONCENTRATION IN ELECTROPHOTOGRAPHIC PRINTER

CROSS-REFERENCE TO RELATED APPLICATIONS

Reference is made to commonly assigned, co-pending U.S. patent application Ser. No. 12/847,192, filed Jul. 30, 2010, entitled Resonant-Frequency Measurement of Electrophotographic Developer Density, by Brown, et al, U.S. patent application Ser. No. 12/847,158, filed Jul. 30, 2010, entitled Electrophotographic Developer Toner Concentration Measurement, by Brown, et al, U.S. patent application Ser. No. 12/847,175, filed Jul. 30, 2010, entitled Electrophotographic Developer Flow Rate Measurement, by Brown, et al, and U.S. patent application Ser. No. 12/847,143 filed Jul. 30, 2010, entitled Measuring Developer Density In An Electrophotographic System, by Brown, et al, the disclosures of which are all incorporated by reference herein.

FIELD OF THE INVENTION

This invention pertains to the field of electrophotographic printing and more particularly to sensing characteristics of developer during printer operation.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

Electrophotographic developer can include toner particles and magnetic carrier particles, and is transported past the photoreceptor by a development member. Developer is compressible, and the image quality of the print image is strongly correlated with developer density. However, existing methods for measuring developer density and other properties require off-line processing, so it cannot provide the data necessary to maintain image quality on-line and thereby improve throughput of a printer.

Commonly-assigned U.S. Publication No. 2002/0168200 ('200) by Stelter et al., the disclosure of which is incorporated herein by reference, describes determining developer mass velocity by, among other things, measuring developer flow rate and developer mass area density (DMAD). Measuring flow rate requires collecting developer in a hopper from a bench-top toning station, and measuring DMAD requires abruptly stopping the toning station. Although these operations are useful, neither is suitable for an operating machine; both are invasive procedures that require the machine to be partially disassembled.

U.S. Pat. No. 6,498,908 to Phillips et al. describes a charge measurement device for measuring charge transfer between a high-voltage power supply and a developing device during an imaging operation. However, charge transfer can occur for various reasons, and it can be difficult to determine which reason affects a particular charge transfer. A single measurement is therefore not always enough information to fix a problem.

U.S. Pat. No. 4,519,696 to Bruyndonckx et al. describes inductive measurement of toner concentration in a developer mixer. However, toner concentration and developer flow rate both affect the percentage of carrier particles in the measurement volume of a sensor, and therefore the toner concentration measured by that sensor.

Commonly-assigned U.S. Pat. No. 4,987,453, the disclosure of which is incorporated herein by reference, describes various embodiments of a capacitive sensor using decay time under applied bias as a signal. Commonly-assigned U.S. Pat. Nos. 5,532,802, 5,463,449, 5,285,243, 5,235,388, 5,122,842, and 5,006,897, and "A Piezoelectric sensor for in situ monitoring of xerographic developers" (by Rimai et al.; Journal of Imaging Science and Technology vol. 39, 1995, pp 136-141), the disclosures of all of which are incorporated herein by reference, describe various embodiments of piezoelectric capacitive sensors. For example, '897 and '842 describe sensors for measuring the toner mass-deposition rate and charge-to-mass ratio. Although useful, these sensors do not measure other significant characteristics of the developer, such as flow rate and toner concentration, and do not separate out different effects from each other.

There is a need, therefore, for an improved way of measuring toner concentration in an electrophotographic system, separating out different effects from each other.

SUMMARY OF THE INVENTION

According to a first aspect of the present invention, there is provided apparatus for determining toner concentration of developer in an electrophotographic printer having a development member, comprising:

a piezoelectric crystal having an electrode adjacent to the development member and electrically insulated from the development member;

first means for applying an AC bias across the crystal and, simultaneously, a DC bias between the electrode and the development member to determine toner-mass deposition rate;

second means for applying an AC bias between the electrode and the development member while developer moves between the electrode and the development member to determine developer flow rate; and a controller for determining the toner concentration of the developer using the measured toner mass-deposition rate and developer flow rate.

According to a second aspect of the present invention, there is provided apparatus for calculating toner concentration of developer in an electrophotographic printer, comprising:

a) a rotatable development member for transporting developer;

b) a piezoelectric crystal having a resonant frequency in operative relationship with and spaced apart from the development member;

c) the crystal including a first electrode on a first face of the crystal, a second electrode on a second face of the crystal, and an electrically conductive lead connecting the second electrode to an electrical contact point disposed over the first face of the crystal, said electrical contact point being electrically insulated from the first electrode, the second electrode being displaced with respect to the development member to define a working volume between the second electrode and the development member through which developer moves, wherein the second electrode is electrically insulated from the development member by the working volume, so that a capacitance is formed between the second electrode and the development member;

d) a casing closed at one end by the crystal with the second face of the crystal permitted to contact developer outside of the closed casing through the opening of the casing, said casing and crystal defining an interior which is sealed from developer, so that within the sealed interior the first face of the crystal is protected from contamination by developer;

e) first means electrically connected to the first electrode and the second electrode for selectively applying a first AC bias having a frequency corresponding to the resonant frequency of the crystal across the crystal, and for selectively applying a first DC bias to the second electrode with respect to the development member;

f) second means electrically connected to the second electrode and the development member for selectively applying a second AC bias having a different frequency than the first AC bias across the working volume;

g) a measuring device electrically connected to the second electrode and the development member for measuring electrical currents through the second electrode; and h) a controller adapted to perform the following functions:

i) cause the first means to apply the first AC bias and the first DC bias to the crystal simultaneously to measure current and resonant-frequency shift due to toner deposition on the crystal;

ii) compute toner mass-deposition rate using the measured current and resonant-frequency shift;

iii) cause the development member to rotate;

iv) while the development member is rotating, cause the second means to apply the second AC bias, and record the current measured by the measuring device;

v) compute developer flow rate using the measured current; and vi) calculate toner concentration using the measured toner mass-deposition rate and flow rate.

According to a third aspect of the invention, there is provided a method of determining toner concentration of developer in an electrophotographic printer having a development member, comprising:

arranging a piezoelectric crystal having an electrode so that the electrode is adjacent to the development member and electrically insulated from the development member;

applying an AC bias across the crystal and, simultaneously, a DC bias between the electrode and the development member to determine toner-mass deposition rate;

applying an AC bias between the electrode and the development member while developer moves between the electrode and the development member to determine developer flow rate; and determining the toner concentration of the developer using the measured toner mass-deposition rate and developer flow rate.

An advantage of this invention is that it provides non-contact measurements. Measurements are taken quickly, in embodiments in real time. Various quantities can be measured in-situ, with no disassembly required. The measurements use inexpensive hardware, and work with any toner/carrier combination. Various embodiments provide individual measurements of specific quantities, not confounded with other quantities.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein:

FIG. 6C shows the conditions used in FIG. 6B;

Figure 1:
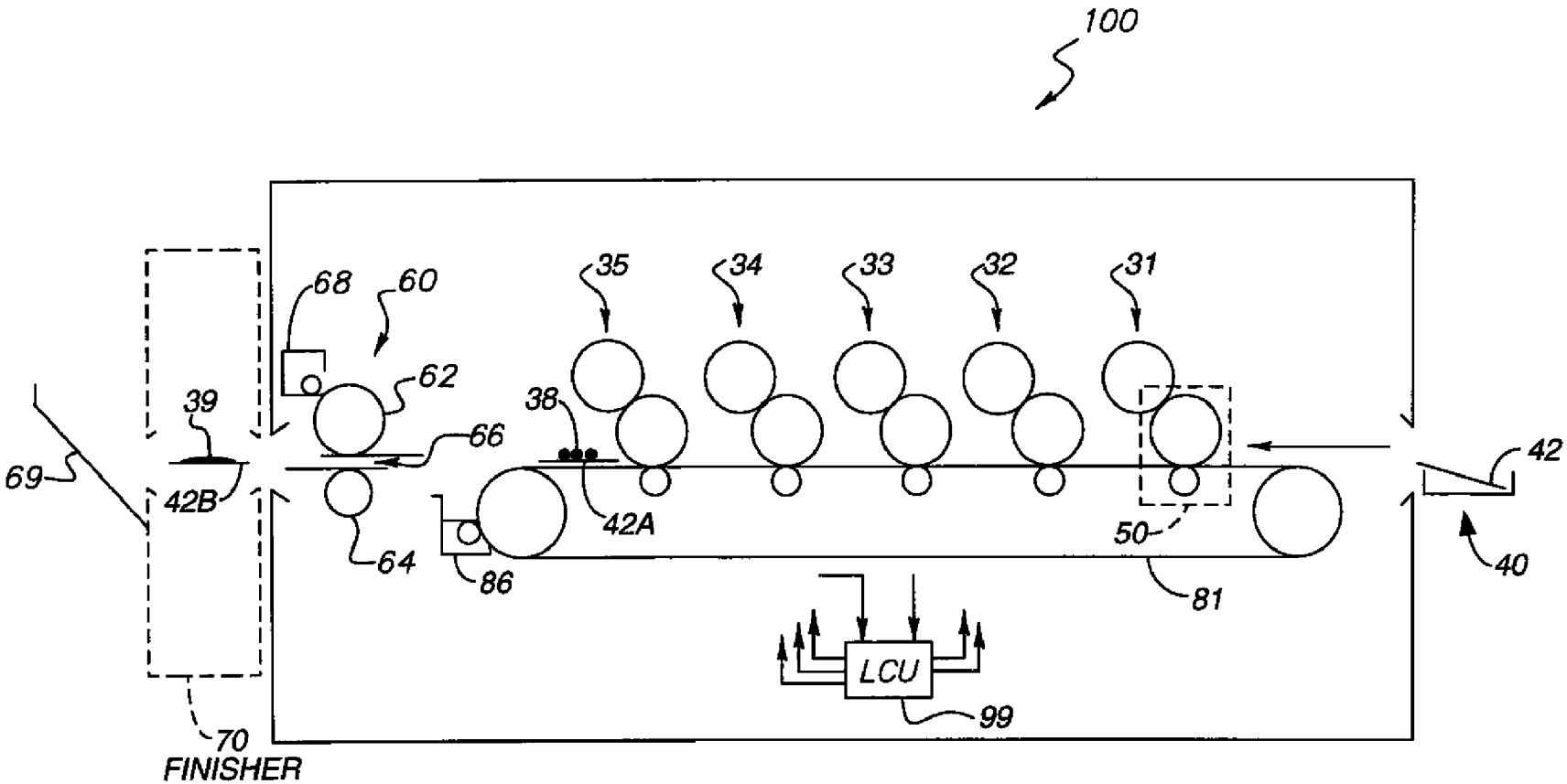
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

In a two-component development system, the ability to apply sufficient developer (toner+carrier, as discussed below) to develop the latent image on the photoconductor is important in producing images with high fidelity and image quality. In various embodiments, developer has a predetermined preferred ratio of toner to carrier (Toner Concentration, or TC). TC is expressed in terms of weight percent of toner to developer. In an embodiment, TC is approximately 6 wt. pct. In various embodiments, developer has a controlled ratio of the charge on a prescribed amount of toner to its mass (Charge/Mass, or q/m ratio, expressed, e.g., in μC/gm). "Developer flow" refers to the amount of developer delivered to the toning zone per unit time. Toning zone 416, shown in FIG. 4C, is the region of space in which toner is transferred from a development member 410 (FIG. 4C) to a photoreceptor 206 (FIG. 4C).

Developer flow can be measured by lowering a gate into the developer stream (e.g., a gate 2" wide) and collecting developer for a specified amount of time (e.g., 0.5 sec). The collected developer is then weighed or massed and reported in units of gm/in/s. Developer flow is correlated to imaging properties of the developer, such as toning contrast and background development. Since the measurement of developer flow aggregates the effects of developer mass density (nap density ND, gm/in$^3$) and developer velocity (nap velocity NV, in/s), the flow measurement is also proportional to the product of independently-measured developer mass density and developer velocity (ND*NV).

As discussed above, this flow-measurement method, although useful, needs to be made with the developer station removed from the machine and requires a scale or balance, so is not well suited for a real-time application. However, it is desirable to measure flow in real time. For example, flat-field uniformity can be improved by increasing the product ND*NV of the developer mass density (ND) (gm/in$^3$) and the developer velocity (NV) (in/s). However, ND cannot be increased arbitrarily. There is a limit on maximum developer density since over-compression of the developer can lead to catastrophic release of the developer from the toning station, e.g., in fully-compressed sheets. This phenomenon is known as Developer Compression Limit Failure (DCL), or "plop-out." Measuring ND and NV separately can reveal different aspects of the developer that can be varied (e.g., velocity) to increase developer ND*NV, and thus improve image quality, without the negative side effects of developer over-compression.

Developer Mass Area Density (DMAD) is another measure of developer density, and is generally measured in terms of gm/in$^2$. DMAD is measured by stopping the printer and collecting the developer on a unit area of development member 410. This measurement, though useful, also cannot be performed in real time.

"Developability" refers to the set of properties of a developer that describe its propensity for being deposited on the photoreceptor as a function of the presence of an electrostatic latent image. Such properties can include the amount of toner deposited per unit area as a function of $V_{dev}$. $V_{dev}$ is the difference of potential between development member 410 and a portion of photoreceptor 206 that is in proximity to development member 410 in toning zone 416. Developability can also include the toner mass-deposition rate, which can be a function of the charge-to-mass ratio (q/m) of the toner, the toner concentration, which can be affected by the size of the carrier particles, the size of the toner particles, and $V_{dev}$. Other factors that affect developability can include the operating parameters of the development station such as the spacing between development member 410 and photoreceptor 206, the rotational speed of development member 410, and the rotational speed of photoreceptor 206. In embodiments using a development member 410 having a rotating shell and rotating magnetic core, the rotational speed of the magnetic core can also affect developability.

As discussed above, image quality is related to developer density. This is discussed further in commonly-assigned co-pending application U.S. Ser. No. 12/333,355, filed Dec. 12, 2008 (Publication No. 2010/0150592), by Kenneth J. Brown, the disclosure of which is incorporated herein by reference.

As used herein, the terms "parallel" and "perpendicular" have a tolerance of ±10°.

As used herein, "sheet" is a discrete piece of media, such as receiver media for an electrophotographic printer (described below). Sheets have a length and a width. Sheets are folded along fold axes, e.g. positioned in the center of the sheet in the length dimension, and extending the full width of the sheet. The folded sheet contains two "leaves," each leaf being that portion of the sheet on one side of the fold axis. The two sides of each leaf are referred to as "pages." "Face" refers to one side of the sheet, whether before or after folding.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the system in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the steps performed by systems according to the present invention.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles, e.g. 15-20 μm or 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
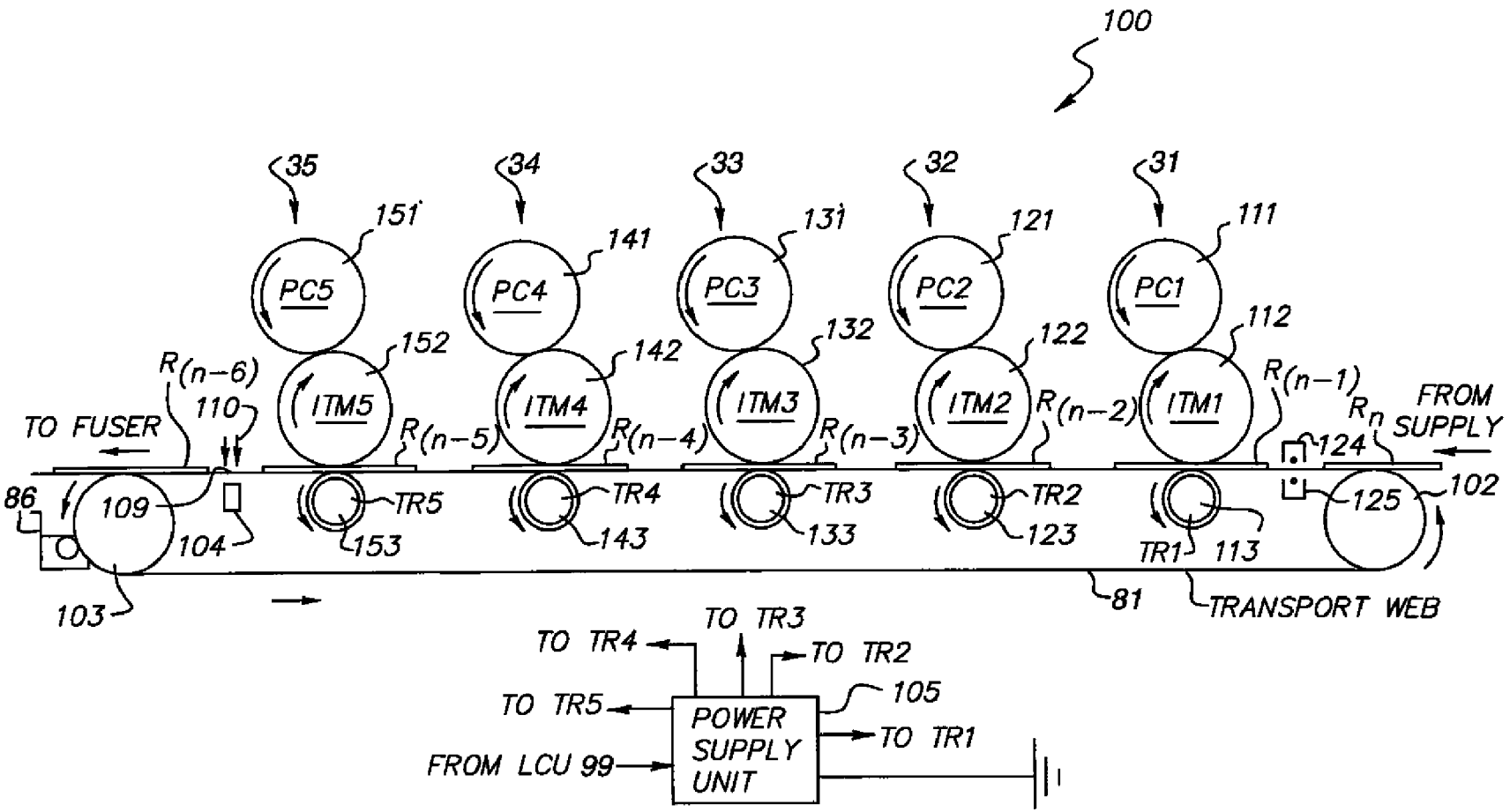
FIG. 2 is an elevational cross-section of the reprographic image-producing portion of the apparatus of FIG. 1.
Figure 3:
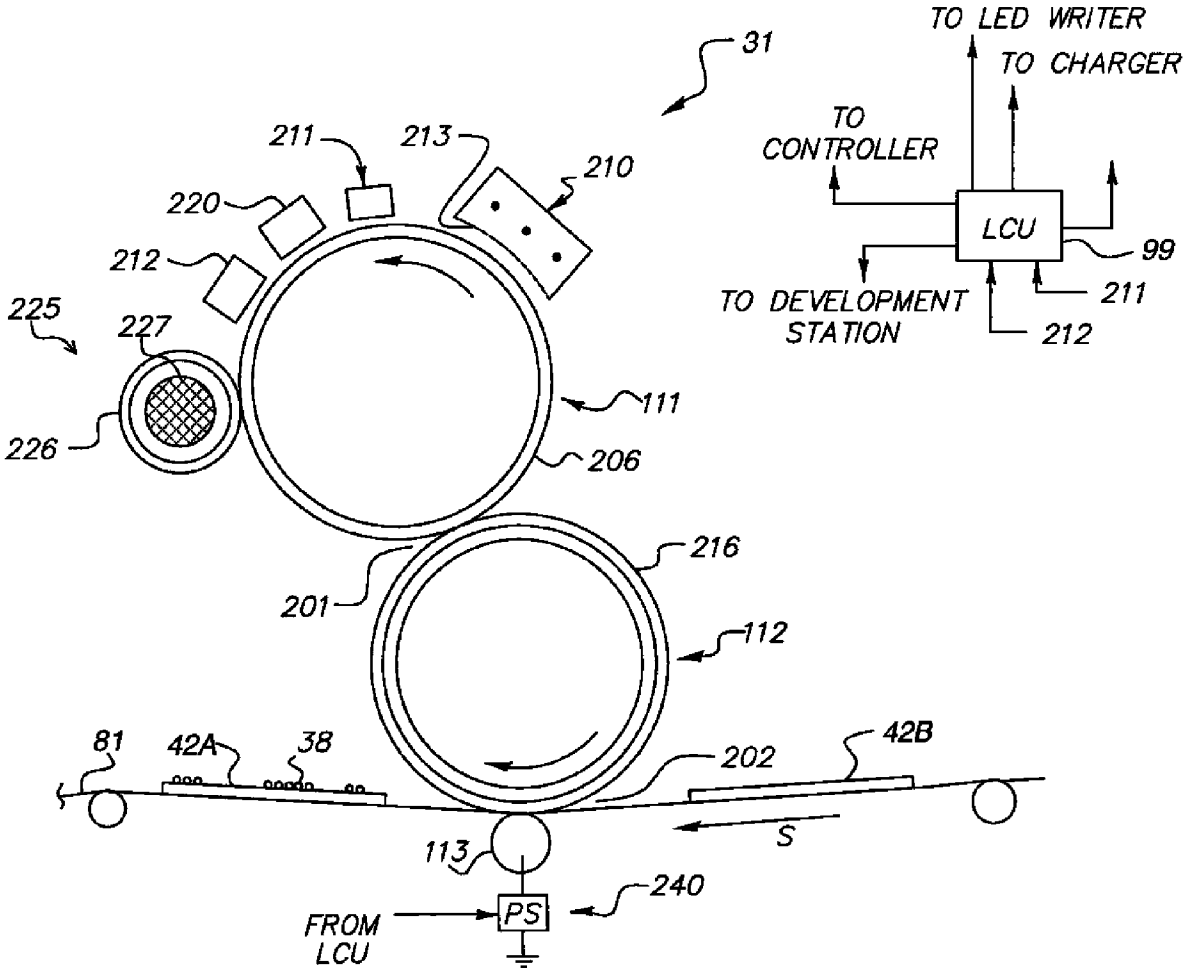
FIG. 3 is an elevational cross-section of one printing module of the apparatus of FIG. 1.

FIGS. 1-3 are elevational cross-sections showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g., fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of the respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on Jun. 22, 2006, by Yee S. Ng et al., the disclosures of which are incorporated herein by reference.

Referring to FIG. 2, receivers $R_n$-$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member (111, 121, 131, 141, 151), e.g. a roller or belt, an intermediate transfer member (112, 122, 132, 142, 152), e.g. a blanket roller, and transfer backup member (113, 123, 133, 143, 153), e.g. a roller, belt or rod. Thus in printing module 31, a print image (e.g. a black separation image) is created on imaging member PC1 (111), transferred to intermediate transfer member ITM1 (112), and transferred again to receiver $R_{(n-1)}$ moving through transfer subsystem 50 (FIG. 1) that includes transfer member ITM1 (112) forming a pressure nip with a transfer backup member TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer members (112, 122, 132, 142, 152), is the fast-scan direction.

A receiver, $R_n$, arriving from supply unit 40 (FIG. 1), is shown passing over roller 102 for subsequent entry into the transfer subsystem 50 (FIG. 1) of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup members 113, 123, 133, 143, and 153. LCU 99 (FIG. 1) provides timing and control signals to the components of printer 100 in response to signals from sensors in printer 100 to control the components and process control parameters of the printer 100. A cleaning station 86 for transport web 81 permits continued reuse of transport web 81. A densitometer array includes a transmission densitometer 104 using a light beam 110. The densitometer array measures optical densities of five toner control patches transferred to an interframe area 109 located on transport web 81, such that one or more signals are transmitted from the densitometer array to a computer or other controller (not shown) with corresponding signals sent from the computer to power supply 105. Transmission Densitometer 104 is preferably located between printing module 35 and roller 103. Reflection densitometers, and more or fewer test patches, can also be used.

FIG. 3 shows more details of printing module 31, which is representative of printing modules 32, 33, 34, and 35. Primary charging subsystem 210 uniformly electrostatically charges photoreceptor 206 of imaging member 111, shown in the form of an imaging cylinder. Charging subsystem 210 includes a grid 213 having a selected voltage. Additional necessary components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g. laser or LED writers), and the respective development station 225 of each printing module 31, 32, 33, 34, 35, among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g. of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 (FIG. 1) which the light source (e.g. laser or LED) can expose with a selected exposure different from the exposure of another engine pixel. Engine pixels can overlap, e.g. to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner particles are charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g. a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. Development station 225 can also employ a mono-component developer comprising toner, either magnetic or non-magnetic, without separate magnetic carrier particles.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g. 42B) which receives the respective toned print images 38 from each printing module in superposition to form a composite image thereon. Print image 38 is e.g. a separation of one color, such as cyan. Receivers are transported by transport web 81. Transfer to a receiver is effected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Figure 4A:
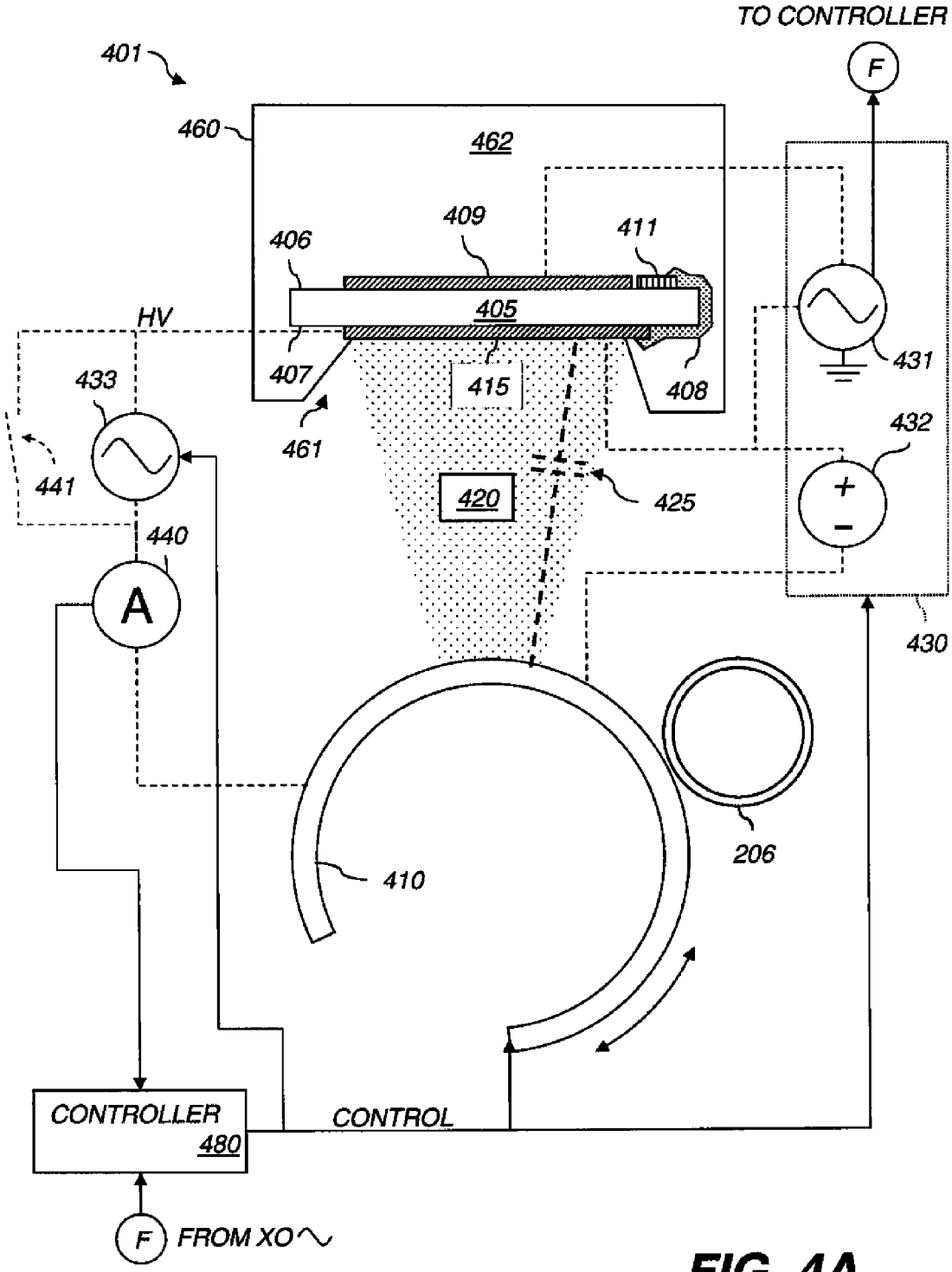
FIG. 4A shows apparatus for determining toner concentration in an electrophotographic system according to an embodiment.

FIG. 4A shows an apparatus for determining or calculating toner concentration of developer in an electrophotographic printer according to an embodiment. Rotatable development member 410, which can be a drum or belt, transports developer to photoreceptor 206. Piezoelectric crystal 405 has a resonant frequency and is arranged in operative relationship with and spaced apart from, development member 410. Piezoelectric crystal 405 is part of sensor 401.

Crystal 405 includes first electrode 409 on first face 406 of crystal 405 and second electrode 415 on second face 407 of crystal 405. Electrically conductive lead 408 connects second electrode 415 to electrical contact point 411 disposed over first face 406 of crystal 405. Electrical contact point 411 is electrically insulated from first electrode 406. Lead 408, electrical contact point 411, and second electrode 415 can be made of the same or different conductive materials, and can be formed together or separately. Lead 408 and contact point 411 permit electrical connection to the associated circuitry. In an embodiment, lead 408 is fully wrapped around the edge of crystal 405 so that contact point 411 and first electrode 409 are located on the same side of crystal 405. A separate electrical contact point electrically connected to first electrode 409 can also be provided, on the same or the opposite side of the crystal as contact point 411.

Second electrode 415 is displaced with respect to development member 410 to define working volume 420 between second electrode 415 and development member 410 through which developer moves. Second electrode 415 is electrically insulated from development member 410 by working volume 420, so that capacitance 425 is formed between second electrode 415 and development member 410.

Casing 460 is closed at one end by crystal 405. Second electrode 415 of crystal 405 is permitted to contact developer outside of casing 460 through the opening 461 of casing 460. Casing 460 and crystal 405 define interior 462 which is sealed from developer, so that within the interior 462, first face 406 of crystal 405 (and also first electrode 409) is protected from contamination by developer.

Power supply unit (PSU) 430 is electrically connected to first electrode 409 and second electrode 415 for selectively applying a first AC bias having a frequency corresponding to the resonant frequency of crystal 405 across crystal 405. This can be done with programmable crystal oscillator 431. PSU 430 also selectively applies a first DC bias to second electrode 415 with respect to development member 410, e.g., using DC supply 432.

PSU 433 is electrically connected to second electrode 415 and development member 410 for selectively applying a second AC bias having a different frequency than the first AC bias across working volume 420. PSU 430 and oscillator 431 can be implemented using a single AC/DC voltage supply or waveform generator or multiple AC or DC generators or supplies.

In an embodiment, DC supply 432 and PSU 433 are implemented using an AC waveform generator. The AC waveform generator generates a changing bias between second electrode 415 and development member 410 (which can be grounded) so that the bias tracks the superposition of the first DC bias (or second DC bias, as described below) and second AC bias.

Measuring device 440 is electrically connected to second electrode 415 and development member 410 for measuring electrical currents through second electrode 415. Measuring device 440 can be an ammeter, galvanometer, Hall-effect sensor, or other current monitor. PSU 433 can be selectively bypassed by switch 441 so that measuring device 440 can measure current without PSU 433 in the circuit.

Controller 480 is adapted to control these components to determine the toner concentration. Controller 480 can be a CPU, GPU, FPGA, PAL, PLD, or other processor known in the art. Controller 480 causes PSU 430 to apply the first AC bias and the first DC bias to crystal 405 simultaneously to measure current and resonant-frequency shift due to toner deposition on the crystal. Current is measured using measuring device 440 with switch 441 closed. Resonant-frequency shift is determined by oscillator 431, which amplifies the voltage between first electrode 409 and second electrode 415 to produce a strong waveform at the resonant frequency F of crystal 405. This waveform, or its frequency F, is provided to controller 480. Oscillator 431 can also provide an AC waveform at a desired frequency across crystal 405.

Deposition on the crystal occurs because the first DC bias causes toner to be attracted to second electrode 415. The toner particles are tribocharged, and the first DC bias induces an electric field in working volume 420 that attracts the particles to second electrode 415.

Controller 480 computes the toner mass-deposition rate using the measured current and resonant-frequency shift. This is discussed below with reference to FIG. 11.

Controller 480 causes development member 410 to rotate. While development member 410 is rotating, PSU 433 applies the second AC bias with switch 441 open. Controller 480 records the current measured by measuring device 440. In an embodiment, the first DC bias and second AC bias are applied at different times.

Controller 480 computes the developer flow rate using the measured current. This is discussed below with reference to FIGS. 5-6D.

Controller 480 then calculates toner concentration using the measured toner mass-deposition rate and flow rate. This is discussed below with reference to FIG. 11.

In an embodiment, second electrode 415 includes two electrically-separated regions (not shown), one of which is driven with the first DC bias while the other is driven with the second AC bias, so that toner mass-deposition rate and developer flow rate are measured simultaneously.

In various embodiments, controller 480 causes development member 410 to stop supplying toner to photoreceptor 206 while the second AC bias is applied. By "stop" it is meant that the intentional transfer of toner to photoreceptor 206 is substantially halted. Dark pickup and other forms of unintentional transfer can occur even when intentional transfer is halted.

In various embodiments, DC supply 432 can selectively apply a second DC bias to second electrode 415 with respect to development member 410. The second DC bias causes toner particles to be repelled from second electrode 415. Controller 480 causes DC supply 432 to apply the second DC bias to second electrode 415 after measuring the current and resonant-frequency shift. This removes toner that was attracted to second electrode 415 by the first DC bias from second electrode 415.

In an embodiment, the second AC bias has a lower frequency than the first AC bias. In another embodiment, the second AC bias has a higher frequency than the first AC bias.

In various embodiments, the first and second AC biases have different frequencies. The frequencies are not harmonics of each other. The amplitudes of the biases are different, and either can be greater. Alternatively, the amplitudes can be equal.

In an embodiment, the first DC bias is not applied to second electrode 415 while the second AC bias is applied to second electrode 415. This advantageously reduces the risk of confounding deposition rate and flow rate.

Figure 4B:
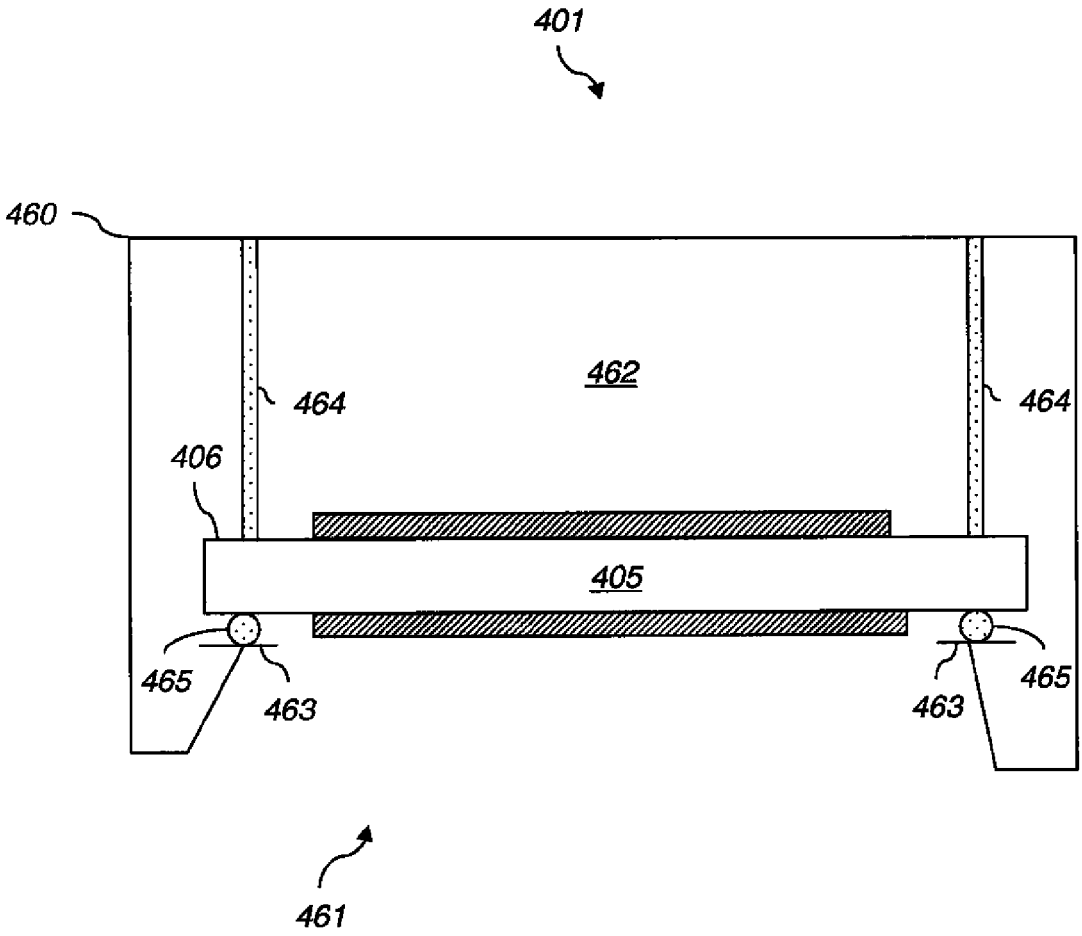
FIGS. 4B and 4C show details of the apparatus of FIG. 4A according to an embodiment.
Figure 4C:
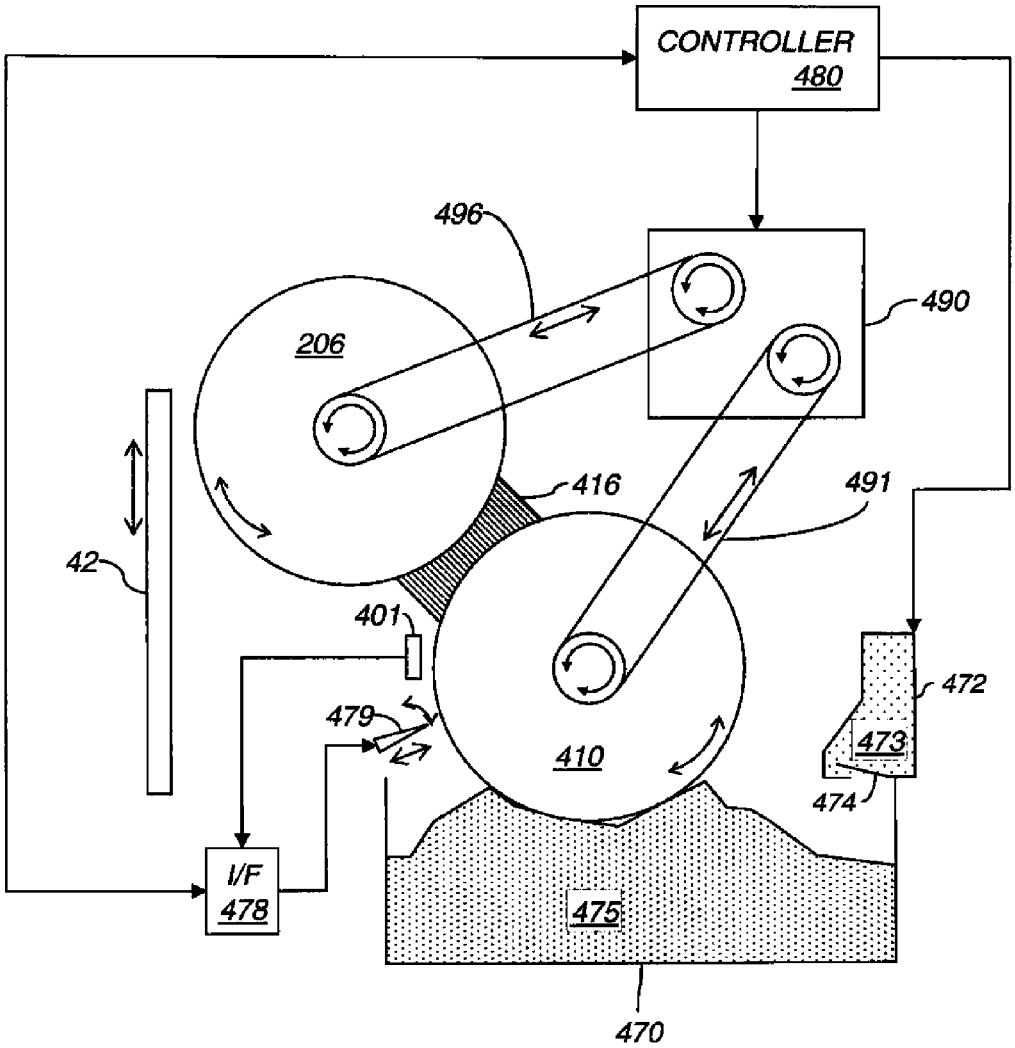

FIG. 4B shows an elevational cross-section of detail of the apparatus for determining toner concentration of developer in an electrophotographic printer according to an embodiment. Crystal 405, first face 406, casing 460, opening 461, and interior 462 are as shown in FIG. 4A. Lip 463 is disposed at the open end of casing 460; crystal 405 is secured against lip 463 by rods 464. Gasket 465 is disposed between lip 463 and crystal 405 so that crystal 405 is secured against lip 463 via gasket 465. Gasket 465, which is preferably formed of an elastomeric material, effectively seals interior 462 to preventing toner particulate contamination in the interior of casing 460. The gasket also electrically insulates crystal 405 from casing 460.

The electrical contact between crystal 405 and the associated electronics (e.g., PSU 430, FIG. 4A) can be accomplished in a variety of ways. In an embodiment, two elastomeric conductors are provided, each containing fine wires (not shown). The elastomeric conductors connect electrical contact point 411 and first electrode 409, respectively, to respective contact points on a circuit board (not shown). Lead 408 (FIG. 4A) is wrapped around the edge of crystal 405, permitting electrical contact with both electrodes to be made within interior 462. Contact can be established by pressure (as with the use of elastomer) or by the use of small amounts of conductive paint, epoxy or solder.

Lip 463 around the front surface of crystal 405 smoothes out the flow of developer as it moves past the crystal 405. In an embodiment, the lip is approximately 0.25 mm thick and acts as a barrier to the waves of developer, performing a skiving action. Accordingly, lip 463 reduces any turbulent flow which can result when there is a build-up of toner. Waves of developer can form around the piezoelectric crystal 405 in the absence of a lip. These waves, which can become sizable, can buffet the piezoelectric crystal. Lip 463 can provide a relatively quiescent region in the vicinity of piezoelectric crystal 10.

FIG. 4C shows another elevational cross-section of detail of apparatus for determining toner concentration of developer in an electrophotographic printer according to an embodiment. Controller 480, photoreceptor 206, and development member 410 are as shown in FIG. 4A. Receiver 42 is as shown in FIG. 1.

Controller causes drive 490 to rotate photoreceptor 206 and development member 410 through respective belts 496, 491. Developer 475 is provided from developer supply 470 to development member 410. Developer 475 is then transferred to photoreceptor 206 in toning zone 416.

Process control strategies use systems which determine the toner concentration or a toner characteristic which influences the toner concentration of at least one of the printing modules during the development of one or more color separations to provide real-time control of the electrophotographic process during the production of subsequent color separations which form the composite image such that quality color productions from the user's perspective are achieved.

Toner characteristics which influence mass-deposition rate can include not only the concentration of the toner mixture, but also other factors such as the charge-to-mass ratio of the toner particles, the charge distribution, and the presence of wrong-sign particles. Other factors, such as mass, time, humidity, and charge, ultimately affect the developed image.

Controller 480 (FIG. 4A) receives signals from sensor 401, and can receive signals from other sensors, e.g., sensors that measure the toner mass-deposition rate (or a toner characteristic which influences the mass-deposition rate), of at least one of the development stations during the development of one or more color separations. Controller 480 compares the received signal to a reference signal indicative of a set point for each development station. Controller 480 determines the error between the actual measured values and reference values, and calculates process control parameter adjustment signals to be applied during the production of subsequent color separations of the composite image such as to achieve enhanced quality color productions.

The process is then adjusted to improve the toner mass deposition. In various embodiments, ways of adjusting the toner mass deposition include one or more of the following. $V_{dev}$ can be adjusted by changing the initial charging of the photoreceptor, changing the potential on the shell of the development station, or changing the exposure level to affect the charge on the photoreceptor corresponding to the electrostatic latent image. The toner concentration or developer flow can be changed.

In various embodiments, the process control parameters adjusted are developer feed rate, metering skive spacing, shell or magnet rotation speeds of development member 410, or toner concentration.

In an embodiment, controller 480 causes adjustable skive 479 to move closer to or farther from development member 410 to control the flow rate of developer. Controller 480 causes the adjustment of skive 479 in response to the calculated toner mass-deposition rate, calculated flow rate, or calculated toner concentration. As indicated on the figure, skive 479 can move linearly or angularly, so that the point on skive 479 closest to development member 410 moves closer to or farther from development member 410. The skive can be adjusted by a solenoid, servo-driving rack and pinion, or other linear or angular positioner known in the art. Controller 480 can determine the desired setting of skive 479 using a user-provided or automatically-determined set point for toner concentration. Controller 480 can operate skive 479 to provide closed-loop control using the feedback from sensor 401, as shown in FIGS. 4A and 4B. Controller can communicate with sensor 401 and the drive for skive 479 directly, or through interface 478, which can be a mux/demux, time-division multiplexer, cable combiner, low-voltage digital signaling (LVDS) transceiver, or other interface known in the art.

In an embodiment, developer 475, including the toner therein, is provided by developer supply 470 to development member 410. Controller 480 provides a signal (analog or digital) in response to the calculated toner concentration indicating that toner is to be added to developer 475. Developer supply 470 is responsive to the signal to automatically add toner to developer 475. Specifically, controller 480 sends the signal to toner supply 472. Toner supply 472 opens gate 474, permitting toner 473 to fall into developer 475. Developer supply 470 includes a mixer, blender, ribbon blender, auger, or other device for mixing the freshly-added toner into the developer 475 already in developer supply 470.

In an embodiment, controller 480 causes drive 490 to adjust the speed of rotation of development member 410 in response to the calculated toner concentration. An encoder on belt 491, development member 410, or the motor in drive 490 can be used to provide closed-loop control of the speed of rotation of development member 410. Alternatively, the speed can be adjusted to maintain the toner concentration at a set point using data from sensor 401.

In an embodiment, the developer flow rate varies while toner is deposited on crystal 405 (FIG. 1) in sensor 401. For example, controller 480 can adjust the speed of rotation of development member 410 and periodically determine toner concentration using sensor 401. This procedure can be used to provide data on the relationship of toner concentration and developer flow rate.

In various embodiments, different printing modules (e.g., 31, 32, 33, 34, 35, shown in FIG. 1) in a printer are mutually controlled by LCU 99, which receives toner concentration data from sensor 401 in each printing module.

Figure 5:
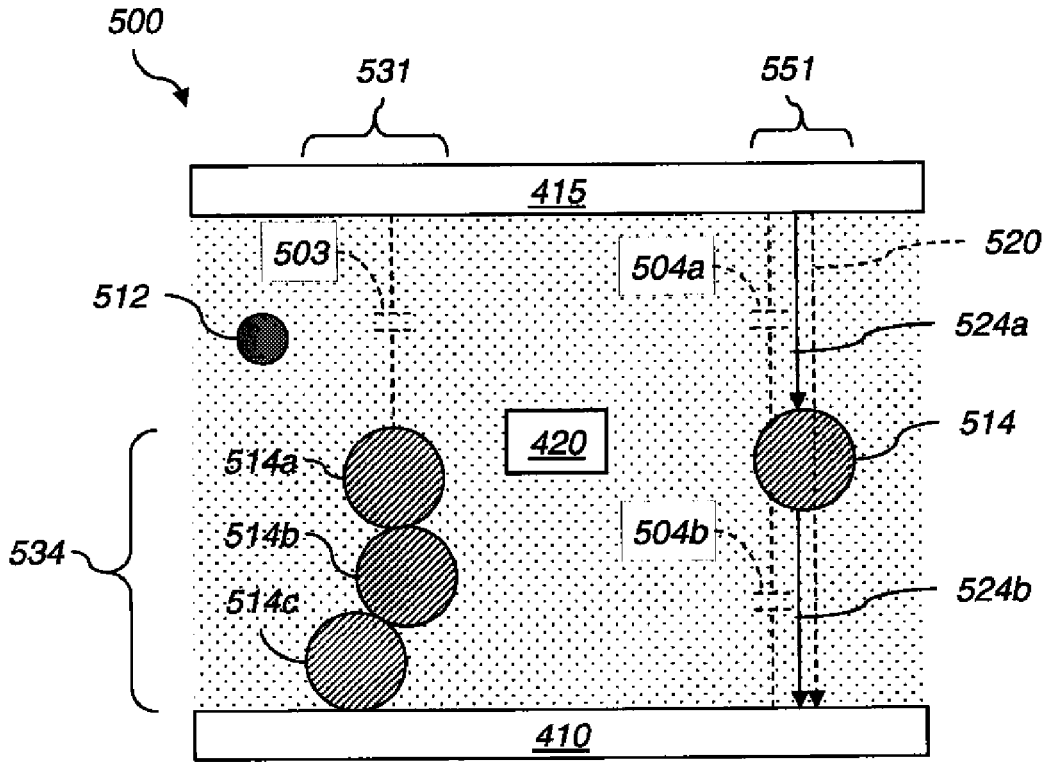
FIG. 5 shows a capacitive sensor.

FIG. 5 shows a capacitive sensor. This sensor can be used to correlate the flow of the developer in the development station to the process factors that affect developer flow. In various embodiments, these factors include some or all of shell and core speeds, the amount of developer on the development member, the rate of augers feeding developer to the shell, and skiving and metering skive settings.

As discussed above, development member 410 and second electrode 415 are two terminals of capacitor 500; working volume 420 and anything in working volume 420 serve as the dielectric of capacitor 500. When working volume 420 is empty of solids, the capacitor is a simple parallel-plate capacitor having the dielectric constant (relative permittivity) of the material in working volume 420 (vacuum=1, pure nitrogen gas at 20° C.=1.0005480, typical air=1.0006). Therefore the capacitance $C=\in_r\in_0 A/d$, for dielectric constant $\in_r$, permittivity of free space $\in_0=8.85\times10^{-12}$ $Fm^{-1}$, common area between the plates A, and distance d between the plates. This is true when there are no free charges between the plates of the capacitor (development member 410 and second electrode 415).

When no free charges are present, and developer is present in working volume 420, the capacitance between the plates increases. The dielectric constant increases when insulating materials such as toner particles or non-conductive carrier particles are added to the working volume, and the geometry of the capacitor changes by splitting capacitors and reducing spacings when electrically-conductive carrier particles are added to the working volume.

When electrically-insulating materials are added to working volume 420, the average dielectric constant of working volume 420 increases. For example, insulating toner particle 512 can have a dielectric constant on its own of 1.7, as discussed in commonly-assigned U.S. Pat. No. 5,655,183 to Tombs, the disclosure of which is incorporated herein by reference. In other embodiments, insulating toner particle 512 has a dielectric constant of 3±0.5, or 3±1. This increase in dielectric constant increases the capacitance of capacitor 500. Another example of an electrically-insulating material is a permanently-magnetized strontium ferrite carrier particle, which is not highly electrically conductive. In various embodiments, carrier particles are coated with polymers or other materials that are triboelectrically complementary to the toner, that is, materials that will charge when rubbed against toner particles. The material can be selected or doped by one skilled in the art to obtain a desired charge polarity and magnitude on the carrier and toner particles. Coated carrier particles can be electrically insulating even if they have an electrically-conductive core, since the outer surface of the particle is coated with an insulator.

When electrically-conductive materials are added to working volume 420, the geometry of capacitor 500 changes. For example, carrier particle 514, made of, e.g., manganese oxide, ferric oxide and titanium dioxide, is a conductor. Such a carrier particle is described in U.S. Pat. No. 6,294,304 to Sukovich et al., the disclosure of which is incorporated herein by reference. As a result, when carrier particle 514 is inserted in working volume 420, electric field line 520 in area 551 is changed to electric field lines 524*a*, 524*b*. Electric field lines

524*a*, 524*b* are shown offset horizontally from electric field line 520 for clarity only. As a result, capacitor 504*a* is formed between development member 410 and carrier particle 514, and capacitor 504*b* is formed between carrier particle 514 and second electrode 415. Each capacitor 504*a*, 504*b* has slightly more than twice the capacitance of the original capacitance between development member 410 and second electrode 415 in area 551, since the distance d for each (the lengths of electric field lines across capacitors 504*a*, 504*b* respectively) has been reduced to less than one-half its former value (here, one-half of the length of electric field line 520 minus one-half of the diameter of carrier particle 514). Capacitors 504*a*, 504*b* add in series to total capacitance $C_T=[1/C_{504a}+1/C_{504b}]^{-1}$, so $C_T>C_{520}$. The more conductive particles are present, the more significant this effect is. Furthermore, conductive particles form additional capacitances between themselves.

Furthermore, as electrically-conductive material in contact with either development member 410 or second electrode 415, but not both, extends over more of the distance between development member 410 and second electrode 415, the capacitance between the free end of the conductive material and the non-contacted electrode increases. For example, chain 534 includes electrically-conductive carrier particles 514*a*, 514*b*, and 514*c*, which are in electrical contact with each other. Carrier particle 514*c* is in electrical contact with development member 410. Capacitor 503 has distance d approximately half its value before chain 534 is formed, so the capacitance in area 531 has approximately doubled.

The result of these effects is that the capacitance of capacitor 500 increases as the density of developer in working volume 420 increases, as long as there are substantially no free charges in working volume 420. The increase in capacitance decreases impedance, increasing current flow. That is, there is a positive correlation between developer density and current flow. An example of this effect is shown in FIG. 6D, below.

When free charges are present in working volume 420, the capacitance C of capacitor 500 cannot be calculated using the parallel-plate formulas. C is a function of capacitor geometry and the distribution of charge in working volume 420. This will now be discussed, with respect to *The Feynman Lectures on Physics, The Definitive Edition Volume* 2 (*2nd Edition*) by Richard P. Feynman, Robert B. Leighton, and Matthew Sands, San Francisco: Pearson/Addison-Wesley, 2005, ISBN 0-8053-9047-2, the disclosure of which is incorporated herein by reference, and particularly with respect to chapters 4, 6, 13, 15, and 17 thereof.

The voltage across a capacitor is by definition the work done in moving a unit charge between the plates against the electric field E between them=Es. The effect of E on the momentum p of a particle with charge q in the field is qE=dp/dt, which is proportional to the acceleration a on the charge when mass is constant (i.e., at velocities v<<c.). Charges between the plates of the capacitor can be arranged in a way that will increase or decrease E at any point between the plates. When E is decreased by adding charge to working volume 420, electrons are decelerated between the plates, decreasing the current between the plates. Moreover, when positive charge is present in working volume 420, it will deflect electrons, increasing the mean path length between the plates of the capacitor and decreasing current (and likewise for negative charge with positive ions as charge carriers). These effects can cause a negative correlation between developer density and capacitor current. An example of a negative correlation is shown in FIG. 6A.

Figure 6A:
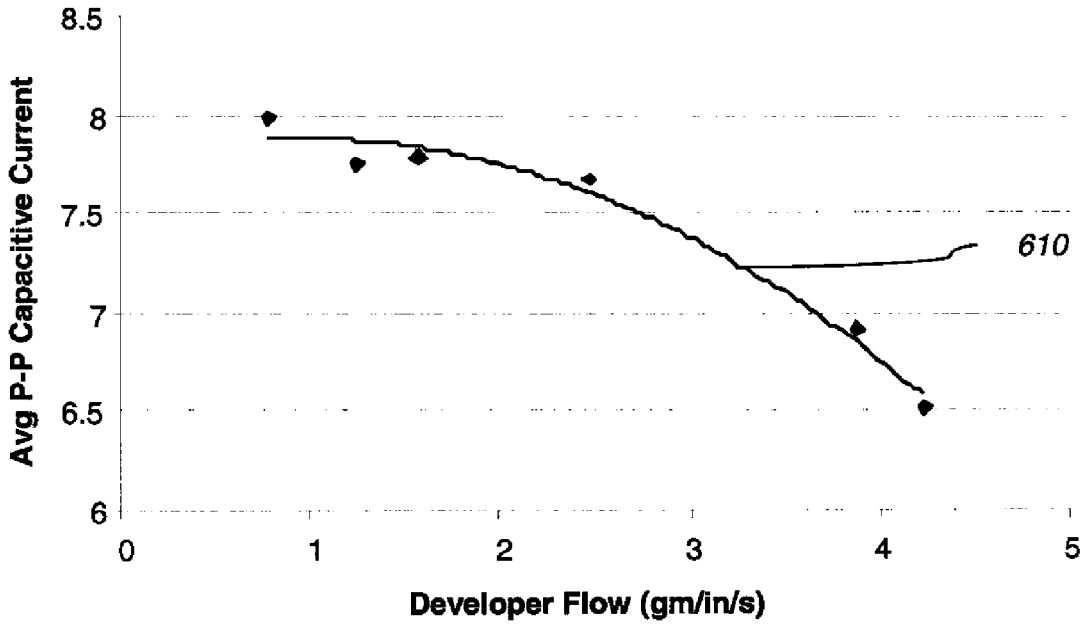
FIG. 6A shows experimental data relating developer flow rate to average peak-to-peak measured current.

FIG. 6A shows experimental data relating developer flow rate on the abscissa to average peak-to-peak measured current $I_{pk\text{-}pk,avg}$ through development member 410, and electrode 415 (FIG. 4) on the ordinate. The plotted points are measured data; curve 610 is a polynomial fit with equation $y=-0.1209x^2+0.2299x+7.7805$ and $R^2=0.9772$. Developer flow rate was used since developer density is difficult to directly control. In the configuration used in this experiment, developer density is negatively correlated with developer flow rate. A 3 $kV_{pk\text{-}pk}$ AC bias at 3 kHz was used, with A≈4 $in^2$ and s≈0.1". Curve 610 shows that as developer flow (thus developer density) rises, $I_{pk\text{-}pk,avg}$ falls.

Figure 6B:
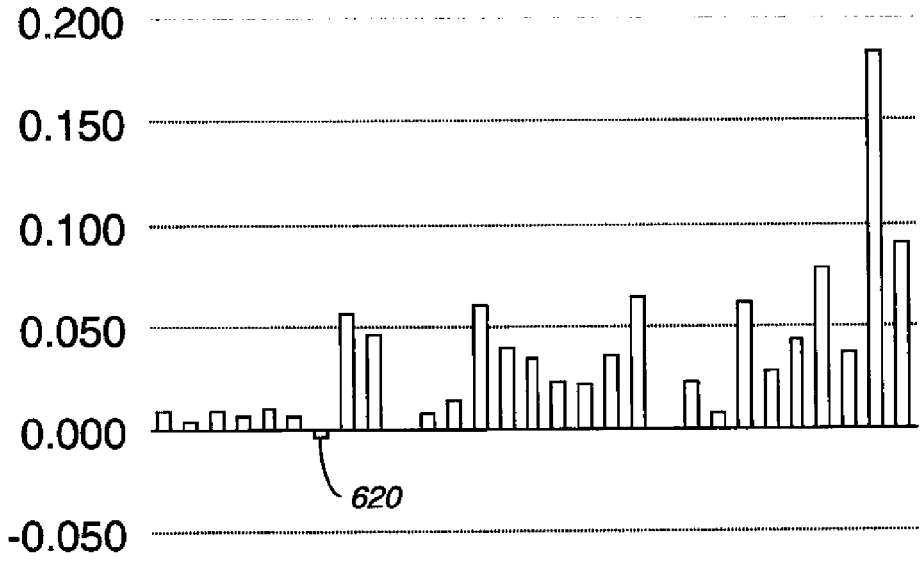
FIG. 6B shows a summary of experimental data relating developer flow rate to average peak-to-peak measured current under various conditions.
Figure 6D:
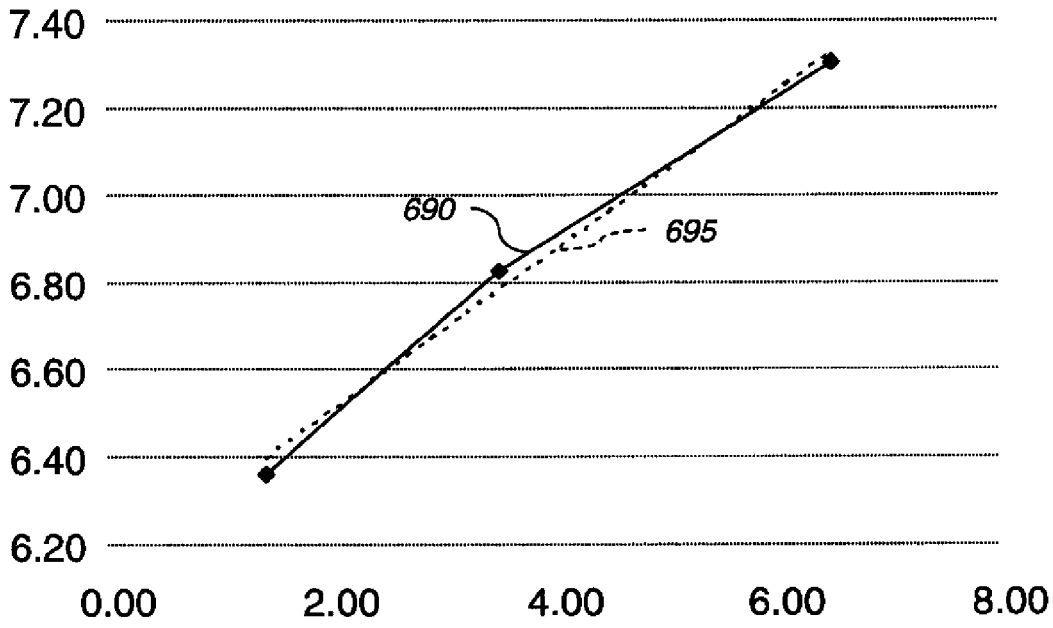
FIG. 6D shows experimental data relating developer flow rate to average peak-to-peak measured current.

FIG. 6B shows a summary of experimental data relating developer flow rate to average peak-to-peak measured current. Various experimental configurations were employed, covering variations in capacitor plate area (A), capacitor thickness (s), and frequency of the AC bias. In each configuration, data were collected relating average peak-to-peak measured current (dependent) to flow rate (independent). A linear fit of the collected data was performed for each configuration. The slopes of the linear fits are shown in FIG. 6B, with one bar per configuration. Most of the slopes were positive, indicating that current increased with flow rate as described above (positive correlation). However, configuration 620 has a negative slope (negative correlation), as do the data shown in FIG. 6A. Therefore, average peak-to-peak measured current can be positively or negatively correlated with developer flow rate.

FIG. 6C shows the conditions used in FIG. 6B. Measurements were taken using various plate areas, voltage amplitudes, frequencies, and electrode spacings. Measurements were taken as described above with respect to FIG. 6B. The slope, intercept, and $R^2$ of the linear fit for each condition are shown in the table. Each condition was measured at three different feed conditions (low/medium/high). The linear fits relate current (dependent) to flow rate (independent). In these tests, the three feed conditions were three voltages of the motor driving the feed roller to feed developer onto the development member. The speed of the development member was constant.

Negative slopes can be due to resonant effects due to parasitics in the measurement system. In practice, the circuit shown in FIG. 4 has parasitic resistances, inductances, and capacitances in addition to capacitance 425, shown. These parasitics can affect the behaviour of the circuit at the frequency of the AC bias, e.g., by adding poles or zeros.

In embodiments with significant parasitics, the DC input currents to PSU 430 (FIG. 4A) are preferably measured instead of the actual AC currents across working volume 420 (FIG. 4A). When performing high-voltage, low-current measurements, parasitics can starve overload the power supply if care is not taken. Measuring the low-voltage, high-current input to PSU 430 reduces the chance of overload.

FIG. 6D shows an example of positive correlation. The axes are the same as FIG. 6A. As developer flow (abscissa, g/in/s) rises, current (ordinate, μA) rises as shown by curve 690. Fit 695 is a linear fit of current, with equation $y=0.1837x+6.132$, and $R^2=0.9918$. Linear, quadratic, or other fits can be made to measured data for ease of computation.

Figure 7:
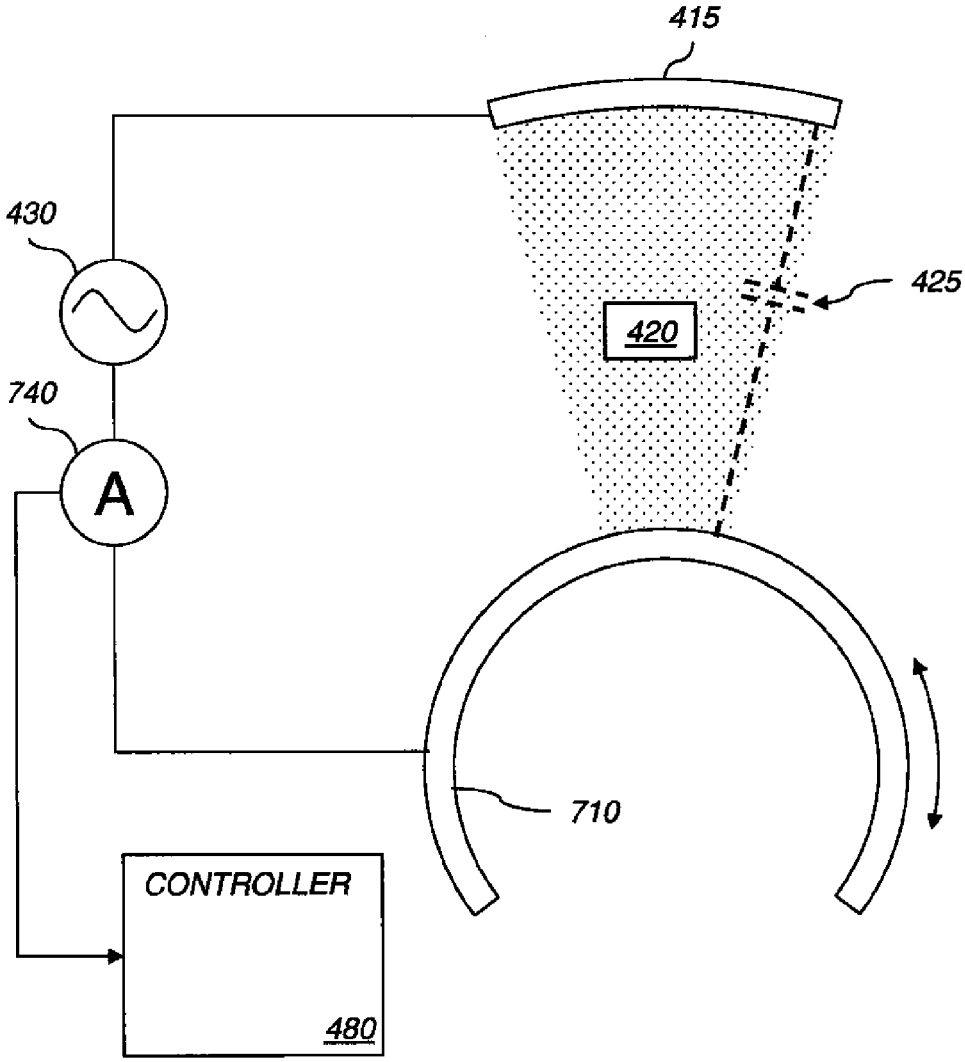
FIG. 7 shows an apparatus for measuring developer density in an electrophotographic system.

FIG. 7 shows apparatus for measuring developer density in an electrophotographic system. Rotatable development member 710 (e.g. toning shell 226) transports developer. Moreover, development member 710 performs the functions of development member 410 (FIG. 4). In an embodiment, development member 710 is grounded. Electrode 415 performs the functions of second electrode 415 shown in FIG. 4. Electrode 415 is displaced with respect to development member 710 to define working volume 420 between them. The shape shown for working volume 420 is merely illustrative; the actual shape of the working volume is defined by the electric field pattern between electrode 415 and development member 710. Developer can move through working volume 420, preferably without contacting the electrode. Electrode 415 is electrically insulated from development member 710 by working volume 420, so that capacitance 425 is formed between the electrode and the development member. PSU 430 is electrically connected to electrode 415 and development member 710 for selectively applying an AC bias, as described above, across working volume 420.

Measurement device 740 is electrically connected to electrode 415 and development member 710 for measuring the capacitance 425 of working volume 420 while development member 710 rotates. Measurement device 740 can include a meter (e.g. measuring device 440, shown in FIG. 4), an ammeter, a voltmeter, a capacitance meter based on resonant-frequency measurements, or another type of capacitance measurement device known in the art. Measurement device 740 can be connected in series with PSU 430, as shown here, or in parallel with it.

Controller 480 automatically determines the density of the developer in the working volume based on the measured capacitance and the applied bias. Controller 480 can include a characterization LUT or function (as described above) mapping measured capacitance and bias to developer density.

Figure 8:
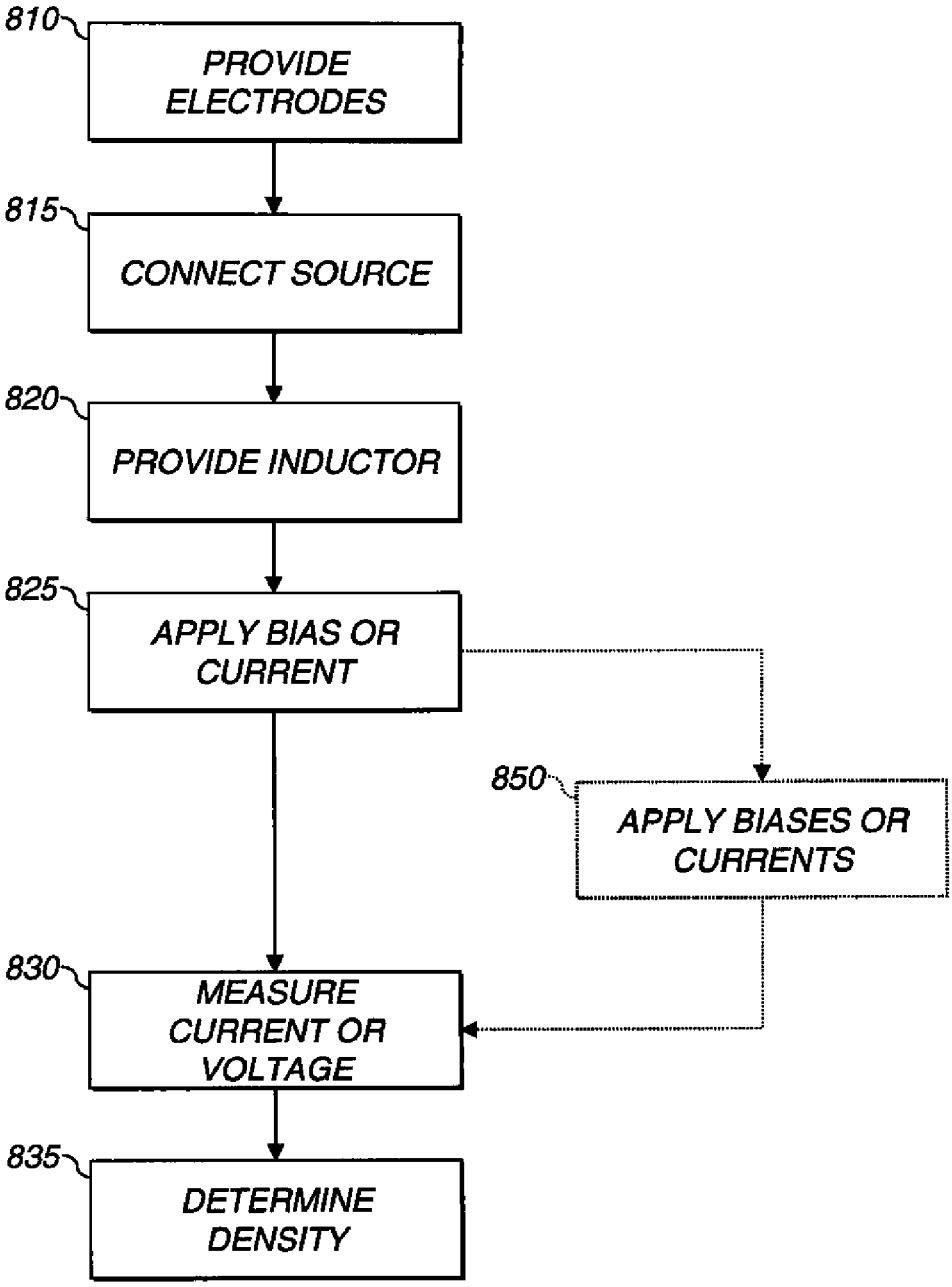
FIG. 8 shows a method of measuring developer density in an electrophotographic system.

FIG. 8 shows a method of measuring developer (i.e., toner, or toner and carrier, as described above) density in an electrophotographic system.

Processing begins with step 810. In step 810, a first electrode and a second electrode are provided, e.g., as shown in FIG. 4. The electrodes are disposed to define a working volume between them through which developer passes without contacting the first electrode, and the electrodes are electrically insulated from each other by the working volume. Step 810 is followed by step 815.

In step 815, one terminal of a power source is connected to one of the electrodes. The power source can be a voltage source or a current source. In embodiments providing a voltage source, the voltage source is adapted to selectively provide an AC bias having a selected magnitude and frequency to the connected electrode. In embodiments providing a current source, the current source is adapted to selectively provide an alternating current having a selected magnitude and frequency to the connected electrode. Step 815 is followed by step 820.

In step 820, an inductor is provided. In embodiments providing a voltage source, the inductor is provided electrically connected in series with the voltage source and is connected to the other of the electrodes, i.e., to the electrode to which the voltage source is not connected. In this way, the voltage source provides the AC bias across the electrodes through the inductor. The voltage source therefore provides the AC bias across a series-resonant tank circuit including the inductor and the capacitance between the electrodes.

In embodiments providing a current source, the inductor is provided electrically connected in parallel with the current source. The current source and inductor are both connected to both of the electrodes, so that the current source provides the alternating current across the electrodes. The current source therefore provides the alternating current into a parallel-resonant tank circuit including the inductor and the capacitance between the electrodes. Step 820 is followed by step 825.

In step 825, a bias is applied using the voltage source, or a current is applied using the voltage source. Step 825 is followed by step 830, or, optionally, step 850. In optional step 850, a plurality of biases or currents having different frequencies is applied. Step 850 is followed by step 830.

In step 830, the current is measured for an applied bias, or the voltage across the current source is measured for an applied current. In embodiments applying a plurality of biases or currents, respective currents or voltages are measured. Step 830 is followed by step 835.

In step 835, the density is automatically determined using a processor (e.g., controller 480, as described above). In embodiments using a single current, density is determined as described above and as shown in FIGS. 4 and 6. The processor is responsive to the measured current and the applied bias.

In embodiments using a single applied alternating current, the processor determines the capacitance of the working volume based on the relationship between applied current and measured voltage, as described above. The processor then automatically determines the density of the developer in the working volume based on the measured capacitance. Processor 450 can include a characterization LUT or function (as described above) mapping measured capacitance and current to developer density.

In embodiments using a plurality of applied biases or currents, the density of the developer can be automatically determined by determining a density for each measurement individually. The measurements are then combined, e.g., by arithmetic or geometric averaging or taking the RMS value (quadratic mean), to produce a single measured density.

In other embodiments using a plurality of applied biases or currents, the density is determined using the processor based on the plurality of biases and the measured respective currents. Specifically, the capacitance of the working volume is automatically determined from the resonant properties of the tank circuit, and the density is determined from the capacitance as described above. In steady-state AC, V=ZI by Ohm's Law, so Z=V/I.

Figure 9:
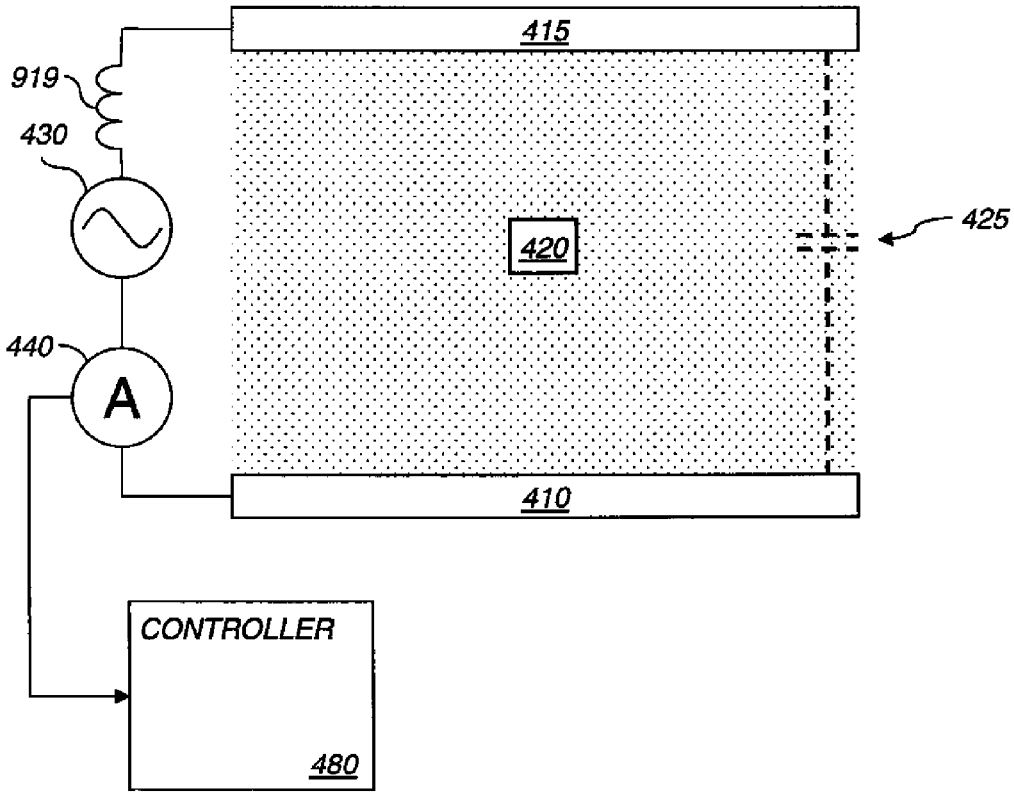
FIG. 9 shows an apparatus using a series-resonant tank circuit and a voltage source.

FIG. 9 shows an apparatus using a series-resonant tank circuit and a voltage source. Development member 410, second electrode 415, working volume 420, capacitance 425, PSU 430, measuring device 440, and controller 480 are as shown in FIG. 4. Inductor 919 is connected in series with PSU 430. V is known, I is measured, and Z is calculated. Each applied bias has a different frequency, and a different Z. At the resonant frequency of the tank, Z=0, neglecting non-idealities such as wire resistance. The resonant frequency $f_r$ is determined by selecting the lowest impedance (highest current for a given applied bias) from the measured current data or by interpolation between measured currents or between calculated impedance values. $f_r=[2\pi(LC)^{1/2}]^{-1}$, and L is known, so C is calculated from L and $f_r$:

$$C = \frac{L}{(2\pi f)^2} \quad \text{(Eq. 1)}$$

The calculated capacitance C is then used to determine density, as discussed above.

Figure 10:
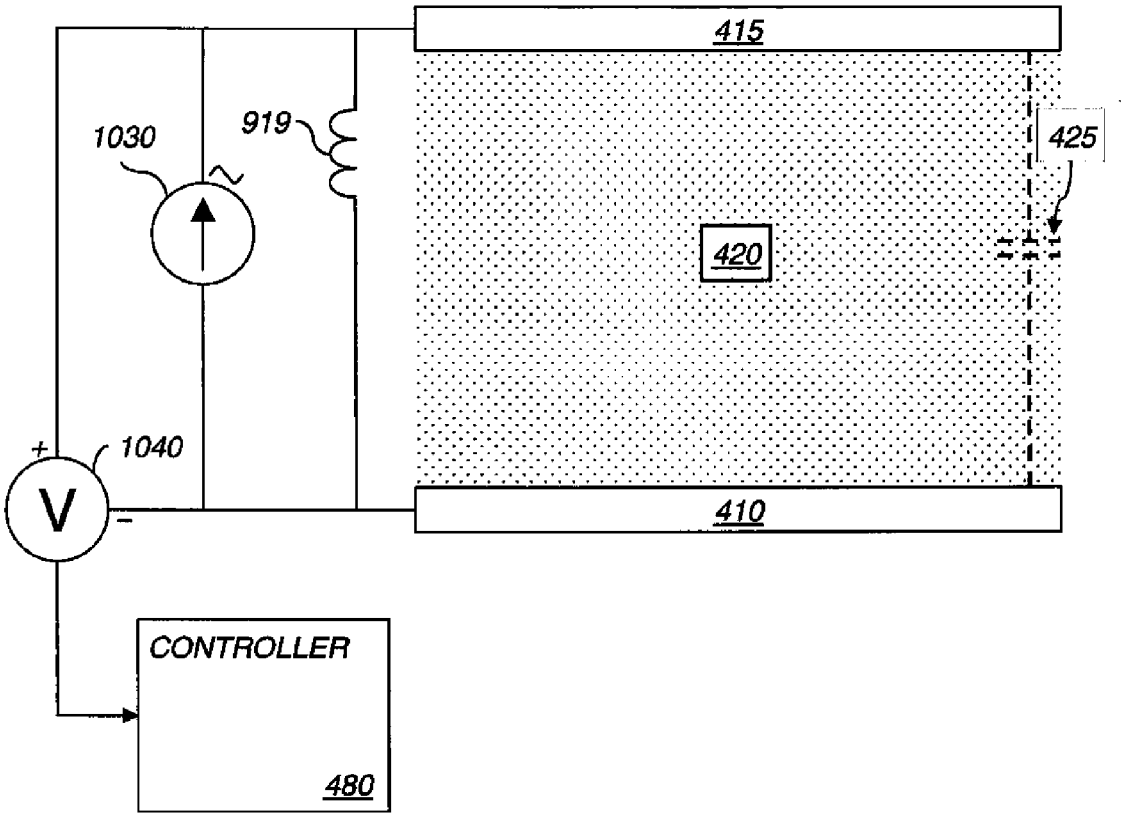
FIG. 10 shows an apparatus using a parallel-resonant tank circuit and a current source.

FIG. 10 shows an apparatus using a parallel-resonant tank circuit and a current source. Development member 410, second electrode 415, working volume 420, capacitance 425, and controller 480 are as shown in FIG. 4. Current source 1030 provides a known alternating current I across capacitance 425 and inductor 919. Measuring device 1040 (e.g., a voltmeter) measures the voltage across current source 1030, inductor 919, and capacitance 425 (the three voltages are the same since they are connected in parallel). I is known, V is measured, and Z is calculated. Each applied bias has a different frequency, and a different Z. At the resonant frequency of the tank, Z=∞, neglecting non-idealities such as series resistance of the inductor. The resonant frequency $f_r$ is determined by selecting the highest impedance (highest voltage for a given applied current) from the measured current data or by interpolation between measured currents or between calculated impedance values. C is calculated from L and $f_r$ using Eq. 1, above. The calculated capacitance C is then used to determine density, as discussed above.

Developer density is related to toner concentration and developer flow rate. In various embodiments, these factors can be determined individually.

Toner concentration can be determined as described above. Adjustments for lost carrier particles and varying magnetic field strengths can be made by those skilled in the electrophotographic art.

In various embodiments of sensors and measurement circuits described above, other configurations of tank circuits are used, including using current or voltage sources with series or parallel tank circuits, as will be obvious to those skilled in the art. In all circuit configurations discussed herein, negative and positive terminals can be interchanged as will be obvious to those skilled in the art.

Figure 11:
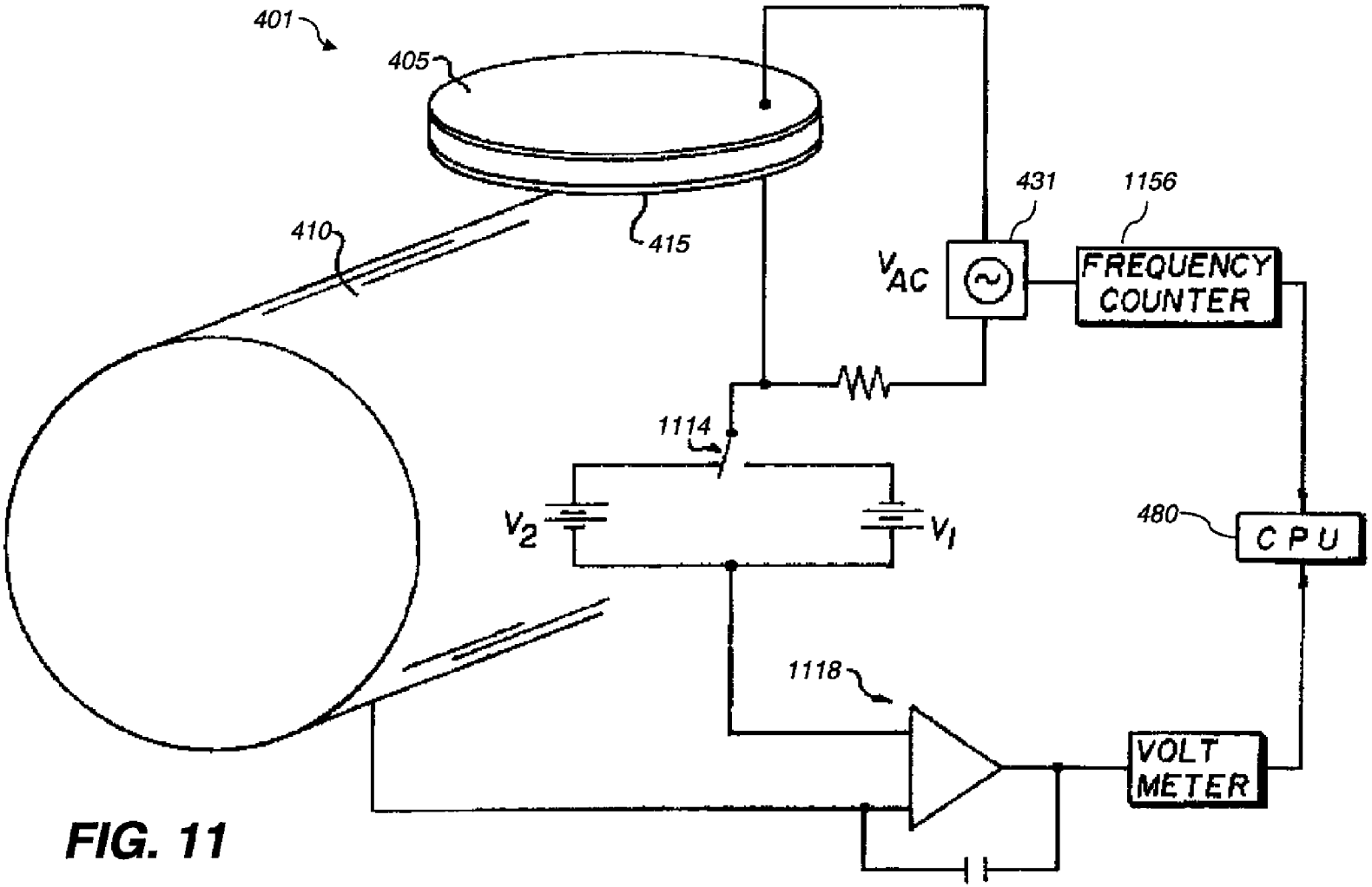
FIG. 11 shows a schematic of a sensor and associated circuitry according to an embodiment.

FIG. 11 shows a schematic of sensor 401 and associated circuitry according to an embodiment. Piezoelectric crystal 405 is positioned in close proximity to development member 410 in a manner approximating the contact of an actual photoreceptor with the developer on development member 410. A crystal-to-roller spacing of approximately 500 μm can be used. Crystal 405 and associated circuitry are used to determine the mass-deposition rate of toner on photoreceptor 206 (FIG. 4A). Controller 480, here labelled "CPU," is as discussed above.

An AC excitation bias, with a frequency corresponding to the resonant frequency of the crystal 405, is applied across the crystal 405 by oscillator 431 (as shown in FIG. 4A). The AC bias is applied beginning at a selected time, $t_0$, while the toning station is run. At time $t_0$, switch 1114 is moved to apply a DC bias, $V_1$, to electrode 415 on one face of crystal 405 in order to attract the toner particles to the crystal. The current between development roller 410 and electrode 415, generated by the passage of charged toner particles from development roller 410 to electrode 415, is integrated by integrator 1118 until an arbitrarily chosen potential across the integrator is reached; and the time $t_1$ needed to reach this potential is determined. In an embodiment, the integrator is operated between ±15 volts and $t_1$ is chosen to occur when the voltage equals zero. These measurements provided the total charge q of the toner deposited on the electrode of the piezoelectric crystal 405 during the time interval $t_1-t_0$.

Simultaneous with the toning current measurement, the shift ca in the resonant frequency of crystal 405 is determined. This shift is related to the mass, m, of the deposited toner by the equation:

$$\omega^2=K/(m+M) \quad \text{(Eq. 2)}$$

where M is the mass of the transducer and K is a constant determined by the elastic moduli of the material. A simple linear mass-deposition rate, R, is calculated as:

$$R=m/(t_1-t_0). \quad \text{(Eq. 3)}$$

More complex models of R can also be made by one skilled in the art. For example, a model for R can take into account the repulsive effects on toner of residual charge on the toner already attracted to second electrode 415. Such a model can include an exponential term. The integrator potential used to determine time $t_1$ can be adjusted to improve the quality of the model fit. For example, integrator potentials can be selected so that deposition of toner over time interval $t_0-t_1$ is approximated by a linear model having a coefficient of determination $R^2>0.5$, or >0.9, or >0.95.

Additionally, the charge-to-mass ratio of the toner, measured in situ, is $$q/m-=CV/m \quad \text{(Eq. 4)}$$

where C is the capacitance across the integrator and V is the change in voltage.

After making the described measurements, the polarity of the DC voltage on second electrode 415 is reversed by switch 1114, so that DC bias $V_2$ is applied to second electrode 415, thereby permitting development member 410 to remove the deposited toner on second electrode 415 and prepare sensor 401 for the next measurement. By the repeated reversing of the DC bias on second electrode 415, cleaning voltages are applied at intervals. The toner particles are cleaned from the electrode by a repelling force. The particles return to development member 410 and are skived back to developer supply 470 (FIG. 4C).

The toner mass-deposition rate depends on the q/m ratio of the toner, the toner size and mass density, and the difference of potential between second electrode 415 and development member 410. The difference of potential decreases as the charged toner particles are deposited onto second electrode 415. Accordingly, in an embodiment, an initial difference of potential ($V_{dev}$) is applied between second electrode 415 and development member 410. The mass deposition rate is then determined by measuring the mass deposited onto the sensor as a function of time and calculating the first derivative of the deposited mass with respect to time at $t_0$. This measurement and calculation can be performed at multiple selected differences of potential to evaluate mass-deposition rate for different exposures (thus different $V_{dev}$ values) on photoreceptor 206.

Any piezoelectric transducer can be used for crystal 405. For example, any of the shear, longitudinal, or mixed mode cuts of quartz or lithium niobate, crystals can be used. In addition, the fundamental frequency of oscillation of these crystals can vary over a wide range of values, from kilohertz or lower frequency to tens of megahertz. In an embodiment providing advantageous physical size, sensitivity, stability, and cost, X-cut quartz transducers with a nominal 1 MHz fundamental frequency are used.

Conductive electrodes can be provided by coating on the opposed faces of crystal 405. The conductive electrode pattern on the crystal can be made from any metal. Metals such as chromium, gold, and aluminum can be used. The patterns can be formed by evaporation or other deposition methods (e.g., sputtering) followed by masking and abrading; or by dissolving electrode material from undesired regions, masking the crystal according to the appropriate design, and then performing the metallic deposition and the subsequent steps described above. In an embodiment, to block DC, second electrode 415 can be coated with insulating material that does not significantly tribocharge against the developer, for example, SiC or $SiO_2$.

In an embodiment, the charge across working volume 420 (FIG. 4A) is inputted to integrator 1118, which includes an operational amplifier with a feedback loop capacitor to integrate transient current. The output of integrator 1118 is the input to an electrometer for determining the charge laid down.

The DC bias is reversed periodically during the operation of the development station so that transients occur each time a development potential is applied to second electrode 415, as described in the above-cited '453 patent. The operational amplifier in integrator 1118 uses a feedback capacitor to form an integrating circuit which integrates the current existing between electrode 415 and development member 410.

As set forth above, electrode 415 is fabricated on a piezoelectric crystal 405. By detecting the change in the resonant frequency of the piezoelectric crystal 405, the mass of the toner particles can be determined.

In the preferred case of strong coupling of the toner to second electrode 415, the resonator is analogous to a mass M attached to a spring of force constant K, where K is determined from the appropriate elastic constants of the crystal. The resonant frequency of the oscillator is inversely proportional to its mass so that:

$$\omega^2=K/M \quad \text{(Eq. 5)}$$

Strong coupling between the toner and second electrode 415 is not required for the operation of the device. As long as the oscillator frequency varies in a known manner with the toner mass, and the toner does not come off of second electrode 415 as a result of the ultrasonic vibrations of crystal 405, the system will work.

If the mass m of toner particles deposited on the oscillator 431 is assumed to be attached by a spring force constant k, the coupled oscillator system will now resonate at a new frequency ω. Using Newton's equations, ω can be found in terms of k, m, K, and M according to the equation of FIG. 4.

In the limit of strong coupling between the toner particles and the oscillator crystal for the ideal case (i.e., K=k), the equation of FIG. 4 becomes:

$$2\omega^2=K/(M+m) \quad \text{(Eq. 6)}$$

Thus, the oscillator frequency is a function of the toner mass on second electrode 415. A discussion of the theory of the relationship between the resonate frequency and mass loading is found in the Journal of Applied Physics 58(7); "A Sensitive New Method for the Determination of Adhesive Bonding Between a Particle and a Substrate"; G. L. Dybwad; Oct. 1, 1985; pp. 2789-2790, the disclosure of which is incorporated herein by reference.

The output of oscillator 431 is inputted to frequency counter 1156 to produce a signal characteristic of the mass of toner on second electrode 415. Alternatively, the output of oscillator 431 can beat against a known test frequency, and the resultant beat frequency can be fed to a frequency-to-voltage converter to produce a signal characteristic of the mass.

In various embodiments, the outputs of the charge measuring circuit and the resonance detection circuit are used to provide signals to controller 480 for process control. Moreover, the development of toner in normal operation produces a current which is the product of the toner mass-deposition rate and the charge-to-mass ratio. This current passes through the supply biasing the development member during normal operation; the member supporting the photoreceptor is typically grounded and the charged toner particles are the charge-transport mechanism.

Controller 480 can calculate factors such as the toner mass-deposition rate, the toner concentration, and the toner mass deposited as a function of process parameters such as the difference of potential between the development station and the photoreceptor.

Controller 480 receives the toner mass-deposition rate from sensor 401, e.g., rate R of Eq. 3, above. Controller 480 also receives the developer flow rate from the capacitive sensor, as shown (for example) in FIG. 6D, above.

The toner concentration (TC) is a function of the mass deposition rate and the developer flow rate. The TC can be calculated from a look-up table that maps these factors to TC. Alternatively, the TC can be calculated using a polynomial fit, e.g., a surface fit, to the mass deposition and developer flow rate. These look-up tables and fits, hereinafter referred to as "mappings," can be determined for a particular printer type before mass production of a printer begins, and stored in each printer constructed of that type. Multiple fits or LUTs can be used; for example, there can be eight fits. Other ways of mapping, such as a neural network or expert system, can also be used. Different mappings can be used for different operating conditions, including different $V_{dev}$ values, temperatures, humidities, toner types or chemistries, toner particle sizes, developer flow rate regimes, developer ages or scumming levels, or machine uptimes (i.e., how long the printer has been turned on, or has been operating in a run mode). For example, one mapping can be used for printing a black text document with relatively low toner deposition, and a different mapping can be used for printing a full-color, full-page photo. This permits more accurately determining toner concentration in the presence of variables affecting the measurements used in the determination.

Specifically, in an embodiment, the toner concentration is determined using mapping. A plurality of mappings is provided for respective job types (e.g., black text or color photo). A mapping is then selected that corresponds to a selected job type, and the selected mapping is used for determining the toner concentration. This permits determining toner concentration in real-time in the presence of a stream of jobs of varying types.

Figure 12:
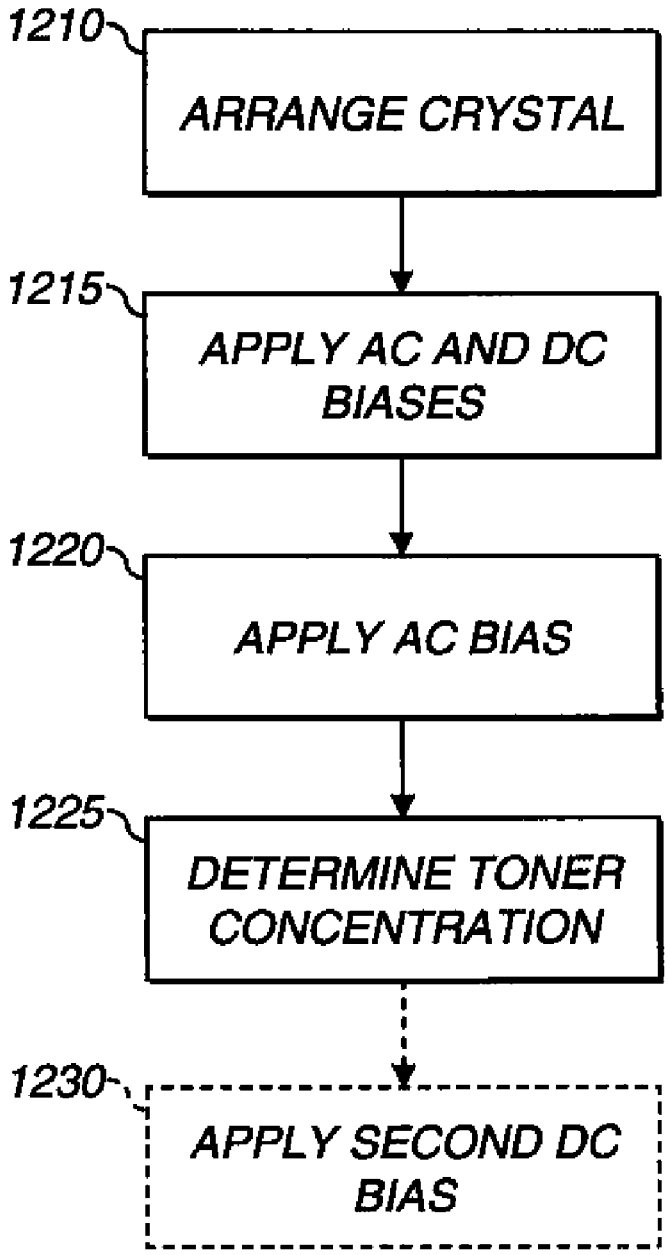
FIG. 12 shows a flowchart of a method of determining toner concentration according to an embodiment.

FIG. 12 shows a method of determining toner concentration of developer in an electrophotographic printer having a development member according to an embodiment. The method begins with step 1210.

In step 1210, a piezoelectric crystal having an electrode is arranged so that the electrode is adjacent to the development member and electrically insulated from the development member. This can be performed as discussed above with reference to FIG. 4A. By "adjacent" it is meant that the electrode is disposed in proximity to the development member so that electric fields can be formed between the electrode and the development member through a working volume. By "electrically insulated" it is meant that the DC resistance between the electrode and the development member under normal operating conditions, when the electrode and the development member are not biased with respect to each other, is sufficiently high to permit a capacitance to form between the electrode and the development member. This resistance is greater than zero, and is preferably greater than 100 kΩ and more preferably greater than 10MΩ. Step 1210 is followed by step 1215.

In step 1215, an AC bias is applied across the crystal. A DC bias is simultaneously applied between the electrode and the development member. Toner-mass deposition rate can be determined as discussed above with reference to FIG. 11. Step 1215 is followed by step 1220.

In step 1220, an AC bias is applied between the electrode and the development member while developer moves between the electrode and the development member. Developer flow rate is determined, e.g., as discussed above with reference to FIGS. 5-6D. Step 1220 is followed by step 1225.

In step 1225, the toner concentration of the developer is determined using the measured toner mass-deposition rate and developer flow rate. This can be performed as discussed above with reference to FIG. 11. Step 1225 is optionally followed by step 1230. In step 1230, a second DC bias is applied to the electrode with respect to the development member. This causes toner particles to be repelled from the electrode, cleaning the electrode to facilitate repeating the mass-deposition sensing cycle (step 1215). This can be performed as described above with reference to FIGS. 4A and 11.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

| | |
|---|---|
| 31, 32, 33, 34, 35 | printing module |
| 38 | print image |
| 39 | fused image |
| 40 | supply unit |
| 42, 42A, 42B | receiver |
| 50 | transfer subsystem |
| 60 | fuser |
| 62 | fusing roller |
| 64 | pressure roller |
| 66 | fusing nip |
| 68 | release fluid application substation |
| 69 | output tray |
| 70 | finisher |
| 81 | transport web |
| 86 | cleaning station |
| 99 | logic and control unit (LCU) |
| 100 | printer |
| 102, 103 | roller |
| 104 | transmission densitometer |
| 105 | power supply |
| 109 | interframe area |
| 110 | light beam |
| 111, 121, 131, 141, 151 | imaging member |
| 112, 122, 132, 142, 152 | transfer member |
| 113, 123, 133, 143, 153 | transfer backup member |
| 124, 125 | corona tack-down chargers |
| 201 | transfer nip |
| 202 | second transfer nip |
| 206 | photoreceptor |
| 210 | charging subsystem |
| 211 | meter |
| 212 | meter |
| 213 | grid |
| 216 | surface |
| 220 | exposure subsystem |
| 225 | development station |
| 226 | toning shell |
| 227 | magnetic core |
| 240 | power source |
| 401 | sensor |
| 405 | piezoelectric crystal |
| 406 | first face |
| 407 | second face |
| 408 | lead |
| 409 | first electrode |
| 410 | development member |
| 411 | electrical contact point |
| 415 | second electrode |
| 416 | toning zone |
| 420 | working volume |
| 425 | capacitance |
| 430 | power supply unit (PSU) |

-continued

PARTS LIST

| | |
|---|---|
| 431 | oscillator |
| 432 | DC supply |
| 433 | PSU |
| 440 | measuring device |
| 441 | switch |
| 460 | casing |
| 461 | opening |
| 462 | interior |
| 463 | lip |
| 464 | rods |
| 465 | gasket |
| 470 | developer supply |
| 472 | toner supply |
| 473 | toner |
| 474 | gate |
| 475 | developer |
| 478 | interface |
| 479 | skive |
| 480 | controller |
| 490 | drive |
| 491, 496 | belt |
| 500 | capacitor |
| 503, 504a, 504b | capacitor |
| 512 | toner particle |
| 514, 514a, 514b, 514c | carrier particle |
| 520, 524a, 524b | electric field line |
| 531 | area |
| 534 | chain |
| 551 | area |
| 610 | curve |
| 620 | configuration |
| 690 | curve |
| 695 | fit |
| 710 | development member |
| 740 | measurement device |
| 810 | provide electrodes step |
| 815 | connect source step |
| 820 | provide inductor step |
| 825 | apply bias or current step |
| 830 | measure current or voltage step |
| 835 | determine density step |
| 850 | apply biases or currents step |
| 919 | inductor |
| 1030 | current source |
| 1040 | voltmeter |
| 1114 | switch |
| 1118 | integrator |
| 1156 | frequency counter |
| 1210 | arrange crystal step |
| 1215 | apply AC and DC biases step |
| 1220 | apply AC bias step |
| 1225 | determine toner concentration step |
| 1230 | apply second DC bias step |
| F | frequency |
| ITM1-ITM5 | transfer member |
| PC1-PC5 | imaging member |
| $R_n$-$R_{(n-6)}$ | receiver |
| S | slow scan direction |
| TR1-TR5 | transfer back up member |
| $V_1$, $V_2$ | bias |

The invention claimed is:

1. Apparatus for determining toner concentration of developer in an electrophotographic printer having a development member, comprising:

a piezoelectric crystal having an electrode adjacent to the development member and electrically insulated from the development member;

first means for applying an AC bias across the crystal and, simultaneously, a DC bias between the electrode and the development member to determine toner-mass deposition rate;

second means for applying an AC bias between the electrode and the development member while developer moves between the electrode and the development member to determine developer flow rate; and a controller for determining the toner concentration of the developer using the measured toner mass-deposition rate and developer flow rate.

2. Apparatus for calculating toner concentration of developer in an electrophotographic printer, comprising:

a) a rotatable development member for transporting developer;

b) a piezoelectric crystal having a resonant frequency in operative relationship with and spaced apart from the development member;

c) the crystal including a first electrode on a first face of the crystal, a second electrode on a second face of the crystal, and an electrically conductive lead connecting the second electrode to an electrical contact point disposed over the first face of the crystal, said electrical contact point being electrically insulated from the first electrode, the second electrode being displaced with respect to the development member to define a working volume between the second electrode and the development member through which developer moves, wherein the second electrode is electrically insulated from the development member by the working volume, so that a capacitance is formed between the second electrode and the development member;

d) a casing closed at one end by the crystal with the second face of the crystal permitted to contact developer outside of the closed casing through the opening of the casing, said casing and crystal defining an interior which is sealed from developer, so that within the sealed interior the first face of the crystal is protected from contamination by developer;

e) first means electrically connected to the first electrode and the second electrode for selectively applying a first AC bias having a frequency corresponding to the resonant frequency of the crystal across the crystal, and for selectively applying a first DC bias to the second electrode with respect to the development member;

f) second means electrically connected to the second electrode and the development member for selectively applying a second AC bias having a different frequency than the first AC bias across the working volume;

g) a measuring device electrically connected to the second electrode and the development member for measuring electrical currents through the second electrode;

h) a controller adapted to perform the following functions:

i) cause the first means to apply the first AC bias and the first DC bias to the crystal simultaneously to measure current and resonant-frequency shift due to toner deposition on the crystal;

ii) compute toner mass-deposition rate using the measured current and resonant-frequency shift;

iii) cause the development member to rotate;

iv) while the development member is rotating, cause the second means to apply the second AC bias, and record the current measured by the measuring device;

v) compute developer flow rate using the measured current; and vi) calculate toner concentration using the measured toner mass-deposition rate and flow rate.

3. The apparatus according to claim 2, further including a lip at the open end of the casing against which the crystal is secured and a gasket disposed between the lip and the crystal so that the crystal is secured against the lip via the gasket.

4. The apparatus according to claim 2, wherein the controller causes the development member to stop supplying toner to the photoreceptor while the second AC bias is applied.

5. The apparatus according to claim 2, further comprising an adjustable skive for controlling the flow rate of developer, wherein the controller causes the adjustment of the skive in response to the computed toner mass-development rate, computed flow rate, or calculated toner concentration.

6. The apparatus according to claim 2, further comprising a supply for providing developer including toner to the development member, wherein the controller provides a signal in response to the calculated toner mass-development rate indicating that toner is to be added to the developer, and the supply is responsive to the signal to automatically add toner to the developer.

7. The apparatus according to claim 2, wherein the controller causes the adjustment of the speed of rotation of the development member in response to the computed flow rate.

8. The apparatus according to claim 2, wherein the developer flow rate varies while the toner is deposited on the crystal.

9. The apparatus according to claim 2, further including means for selectively applying a second DC bias to the second electrode with respect to the development member, wherein the controller causes the means to apply the second DC bias to the second electrode after measuring the current and resonant-frequency shift, so that toner particles are repelled from the second electrode.

10. The apparatus according to claim 2, wherein the second AC bias has a lower frequency than the first AC bias.

11. The apparatus according to claim 2, wherein the first DC bias is not applied to the second electrode while the second AC bias is applied to the second electrode.

12. A method of determining toner concentration of developer in an electrophotographic printer having a development member, comprising:

arranging a piezoelectric crystal having an electrode so that the electrode is adjacent to the development member and electrically insulated from the development member;

applying an AC bias across the crystal and, simultaneously, a DC bias between the electrode and the development member to determine toner-mass deposition rate;

applying an AC bias between the electrode and the development member while developer moves between the electrode and the development member to determine developer flow rate; and determining the toner concentration of the developer using the measured toner mass-deposition rate and developer flow rate.

13. The method according to claim 12, further comprising applying a second DC bias to the electrode with respect to the development member so that toner particles are repelled from the electrode.

14. The method according to claim 12, wherein the toner concentration is determined using mapping, further comprising:

providing a plurality of mappings for respective job types; and selecting a mapping corresponding to a selected job type for determining the toner concentration.

* * * * *